US005747942A

United States Patent [19]

Ranganath

[11] Patent Number: 5,747,942

[45] Date of Patent: May 5, 1998

[54] INVERTER FOR AN ELECTRONIC BALLAST HAVING INDEPENDENT START-UP AND OPERATIONAL OUTPUT VOLTAGES

[75] Inventor: Krishnappa Ranganath, Schaumburg, Ill.

[73] Assignee: Enersol Systems, Inc., Hoffman Estates, Ill.

[21] Appl. No.: 677,467

[22] Filed: Jul. 10, 1996

[51] Int. Cl.[6] ..... H05B 37/02

[52] U.S. Cl. ..... 315/224; 315/219; 315/291; 315/307; 315/278; 315/209 R; 315/DIG. 4

[58] Field of Search ..... 315/219, 224, 315/212, 209 R, 244, 247, 278, 291, 307, 308, DIG. 4, DIG. 5, DIG. 7

[56] References Cited

U.S. PATENT DOCUMENTS

| | | | |
|---|---|---|---|
| 4,095,139 | 6/1978 | Symonds et al. | 315/153 |
| 4,210,846 | 7/1980 | Capewell et al. | 315/121 |
| 4,508,996 | 4/1985 | Clegg et al. | 315/224 |
| 4,700,113 | 10/1987 | Stupp et al. | 315/224 |
| 5,055,746 | 10/1991 | Hu et al. | 315/291 |
| 5,309,062 | 5/1994 | Perkins et al. | 315/53 |
| 5,321,337 | 6/1994 | Hsu | 315/219 |
| 5,381,076 | 1/1995 | Nerone | 315/209 |
| 5,387,846 | 2/1995 | So | 315/209 |
| 5,394,064 | 2/1995 | Ranganath et al. | 315/209 |
| 5,396,155 | 3/1995 | Bezdon et al. | 315/291 |
| 5,404,082 | 4/1995 | Hernandez et al. | 315/219 |
| 5,410,221 | 4/1995 | Mattas | 315/307 |
| 5,416,387 | 5/1995 | Cuk et al. | 315/209 |
| 5,432,695 | 7/1995 | Vlatkovic et al. | 363/138 |
| 5,457,360 | 10/1995 | Notohamiprodjo et al. | 315/219 |
| 5,463,284 | 10/1995 | Mattas | 315/240 |
| 5,479,074 | 12/1995 | Nilssen | 315/209 |
| 5,485,057 | 1/1996 | Smallwood et al. | 315/58 |

*Primary Examiner*—Robert Pascal
*Assistant Examiner*—Haissa Philogene
*Attorney, Agent, or Firm*—Darin E. Bartholomew

[57] ABSTRACT

The electronic ballast for a gas-discharge lamp includes an inverter. The inverter uses the combination of a step-up transformer, a resonant circuit, and clamping diodes to provide an operational inverter output voltage that is independent of the start-up output voltage of the inverter. During the start-up mode, the step-up transformer is used to provide the start-up voltage for the lamp and the resonant circuit is inactive. Clamping diodes prevent or inhibit the resonant circuit from resonating with potential parasitic capacitances during the start-up mode. During the operational mode, an oscillator is tuned relative to the resonant frequency of a resonant circuit to control the brightness of the fluorescent lamp.

35 Claims, 14 Drawing Sheets

INVERTER FOR AN ELECTRONIC BALLAST HAVING INDEPENDENT START-UP AND OPERATIONAL OUTPUT VOLTAGES

FIELD OF INVENTION

The present invention relates generally to electronic ballasts for gas-discharge lamps. In particular, the present invention relates to inverters for electronic ballasts that are compatible with a wide assortment of international and domestic fluorescent lamps.

BACKGROUND ART

An electronic ballast must perform several functions to reliably light a lamp. First, the ballast energizes the lamp electrodes to bring the electrodes up to operating temperature. Second, after preheating the electrodes, the ballast introduces a sufficient voltage between the electrodes to start electrons flowing through the lamp. Third, the ballast places an impedance in series with the lamp to limit the lamp operating current to a safe value.

An electronic ballast often consists of a converter coupled to an inverter. The input of the converter is typically 50 Hz or 60 Hz alternating current (AC) power. The output of the converter is a regulated, high-voltage, direct current (DC) source for the inverter. The inverter provides AC power, typically at frequencies of 30 KHz to 60 KHz, with appropriate voltages for fluorescent lamps.

The output voltage of the inverter is best described by two modes. The first mode or start-up mode occurs when alternating current (AC) power from the inverter is first applied to an inactive fluorescent lamp. The second mode or operational mode occurs subsequent to the start-up mode. During the operational mode the fluorescent lamp starts conducting through electron flow. The start-up mode requires a greater AC voltage than the operational mode does. The operational mode requires regulation of current delivered to the load.

In the background art the differences between the start-up mode voltage and the operational mode voltage are obtained by changing an oscillator frequency relative to the resonant frequency of a resonant circuit. The resonant circuit usually consists of a capacitor and an inductor. The lamp is often in parallel with the capacitor and in series with the inductor. The capacitor and the inductor conduct current and form a resonant circuit, even when the lamp is disconnected or inactive.

A control circuit varies the frequency applied to the resonant circuit depending upon whether the inverter is operating in the start-up mode or operational mode. The resonant circuit decreases the AC output voltage for the operational mode and increases the AC output voltage for the start-up mode. Special circuitry is needed to prevent abnormal operation when the inverter frequency is changed.

The prior art discloses various control and protection circuits to prevent inverter failure when the lamp fails or is removed from the circuit. Some background art electronic ballasts use control feedback to detect the absence or malfunction of the lamp. Certain background art electronic ballasts use diodes to protect against excessive voltages at the lamp, which would otherwise contribute to premature lamp and inverter failure. Many background art patents disclose protection circuits for electronic ballasts that use resonant circuits during both the start-up mode and the operational mode.

The inherent frequency versus amplitude response of the resonant circuit often limits the maximum voltage difference between the start-up mode and the operational mode. Accordingly, some electronic ballasts are limited to applications with particular lamps, which have voltage requirements compatible with the frequency versus amplitude of the lamp's resonant circuit. Similarly, dimming electronic ballasts may only provide dimming of the fluorescent lamp over a limited range because of the inherent limitations of the resonant circuit. Therefore, a need exists for an electronic ballast with a broad range of voltage outputs suitable for illuminating fluorescent lamps with different voltage input characteristics. In other words, the need exists for an electronic ballast that can operate with a wide variety of lamps.

SUMMARY OF THE PRESENT INVENTION

The electronic ballast of the present invention includes a converter and an inverter for powering a gas-discharge lamp. The power output of the inverter is best described by two modes. The first mode or start-up mode occurs when alternating current (AC) power from the inverter is first applied to the lamp. The second mode or operational mode occurs subsequent to the start-up mode. The start-up mode requires a greater AC voltage than the operational mode does. The inverter output voltage remains constant during the start-up mode regardless of oscillator frequency. However, during the operational mode, a user may vary the inverter output voltage by changing the oscillator frequency.

The inverter uses the combination of a step-up transformer, a resonant circuit, and clamping diodes to provide an operational inverter output voltage that is independent of the start-up voltage of the inverter. The inverter is capable of operating with a wide variety of lamps.

During the start-up mode, a step-up transformer is used to provide the start-up voltage for the lamp and the resonant circuit is inactive. The resonant circuit does not contribute to the start-up voltage. The start-up voltage is available substantially independent of the frequency of the oscillator.

Parasitic capacitances can potentially activate the resonant circuit during the start-up mode. Parasitic capacitances may arise from the geometry of the lighting fixture. Clamping diodes prevent or inhibit the resonant circuit from resonating with potential parasitic capacitances during the start-up mode.

During the operational mode, an oscillator is tuned relative to the resonant frequency of a resonant circuit (i.e. a series resonant circuit) to control the brightness of the fluorescent lamp. The operational mode uses the frequency versus amplitude response of the resonant circuit to develop the necessary operational voltage to operate the fluorescent lamp. For example, a series resonant circuit may be used to attenuate the inverter output voltage.

The inverter comprises a lamp control circuit, a control interface, a square-wave amplifier, a resonant circuit, clamping diodes, and a step-up transformer. The lamp control circuit controls the oscillator frequency of an oscillator in response to input at the control input interface. The lamp control circuit provides a square-wave output signal at the oscillator frequency.

The lamp control circuit includes an oscillator controller, an oscillator, and a driver. The oscillator controller provides a frequency-determining control signal to the oscillator. The oscillator oscillates at an oscillator frequency determined by the frequency-determining control signal. The driver provides the square-wave output signal of the lamp control circuit.

A square-wave amplifier amplifies the signal from the driver output. The square-wave amplifier is a semiconductor switch assembly. For example, the square-wave amplifier may be a half-bridge arrangement for an inverter circuit.

The resonant circuit is coupled to the output of the square-wave amplifier. The resonant circuit comprises a first resonant element and a second resonant element. A step-up transformer preferably intervenes between the first resonant element and the second resonant element. The first resonant element is connected to the square-wave amplifier. The second resonant element is connected to the step-up transformer.

The user may manually adjust the control input interface to control the luminance of the lamp. The control input interface permits a user to change the oscillator frequency by adjusting a variable resistor, adjusting the gain of an amplifier, adjusting the input power to an amplifier, applying a variable DC voltage source, monitoring the DC bus voltage, or the like. The oscillator controller provides a frequency-determining voltage to the oscillator in response to the control input. The oscillator frequency relative to the resonant frequency of the resonant circuit determines the inverter output voltage. By varying the inverter output voltage, the brightness of the lamp may be controlled.

The electronic ballast of the present invention applies to a broad spectrum of commercially available lamps. The electronic ballast uses simple, open-loop control of the inverter, which does not require feedback circuitry. The electronic ballast conveniently allows a user to adjust the ballast power output to accommodate the power input requirements of many commercially available lamps.

In contrast, background art electronic ballasts are often narrowly tailored to meet particular lamp specifications. In other words, a different electronic ballast is potentially required for each distinct lamp type. Accordingly, retailers, distributors, and contractors may decrease inventory of electronic ballasts by offering the electronic ballast of the present invention as a replacement for multiple prior art ballasts.

The electronic ballast of the present invention may be used in task lighting applications. Optimization of light levels is referred to as "task lighting". Task lighting is directed at efficient use of lighting on a "as required basis" to reduce energy costs. Task lighting bases the level of illumination on the desired use of the particular area. For example, users of walkways and corridors need less light than office areas where desks are often located.

In an alternate embodiment of the present invention, the electronic ballast comprises a central ballast unit and a group of remote inverters. The central ballast unit includes a converter and a main lamp control circuit. The converter provides DC power for the group of remote inverters. Accordingly, the converter must provide sufficient DC power output capacity to power the remote inverters.

Because prior art embodiments of the electronic ballast use one converter for every inverter, the total lighting system cost may reduced by approximately one-half when the larger central ballast unit replaces multiple, smaller converters. Product cost savings are evident in projects requiring as few as twenty-five electronic ballasts.

DETAILED DESCRIPTION OF THE PREFERRED EMBODIMENTS

Block Diagram of the Electronic Ballast

Figure 1A:
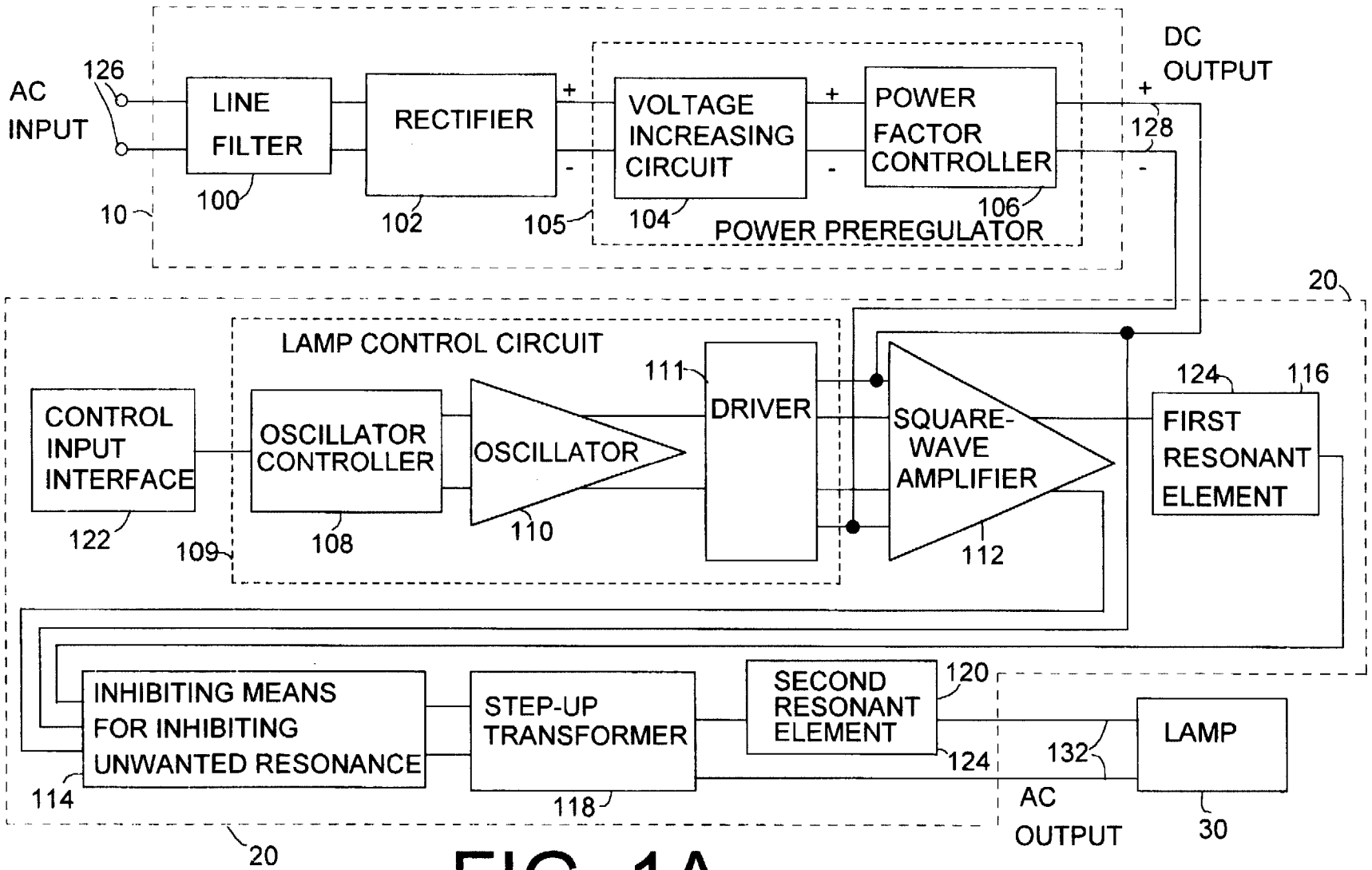
FIG. 1A is a block diagram of a first embodiment of the electronic ballast.

Referring to FIG. 1A, the electronic ballast of the present invention has two main subassemblies: a converter 10 and an inverter 20. The converter 10 converts alternating current (AC) power applied to a converter input 126 into regulated, direct current (DC) power at a converter output 128. The inverter 20 converts the DC power into AC power at an inverter output 132. The AC power at the inverter output 132 is suitable for powering a gas-discharge lamp 30. The voltage, current, and frequency of the AC power are controlled by the electronic ballast. The AC power at the inverter output 132 has a higher frequency than the AC power at the converter input 126.

The converter 10 includes a line filter 100, a rectifier 102, and a power preregulator 105. The line filter 100 has an inductor, a capacitor, or a combination of inductors and capacitors. The line filter 100 contributes to the maintenance of a constant output voltage despite energy fluctuations. The line filter 100 attenuates unwanted radio frequency interference originating from the converter input 126.

The rectifier 102 turns AC voltage from the line filter 100 into unregulated DC voltage. The rectifier 102 comprises, for example, a full-wave bridge rectifier.

The power preregulator 105 comprises a voltage increasing circuit 104 associated with a power factor controller 106. The voltage increasing circuit 104 raises the voltage with respect to the DC output of the rectifier 102. The voltage increasing circuit 104 may comprise an inductive circuit which is periodically shunted to ground via a switch. Shunting the inductive circuit causes fluctuations and disruptions in the current flowing in the inductive circuit. In response to current changes, the inductive circuit produces high voltages.

The power factor controller 106 controls and regulates the DC power from the output of the voltage increasing circuit 104. The power factor controller 106 may be any commercially available power factor controller. The power factor controller 106 affects the power factor at the converter input 126. The power factor is the degree of reactance and resistance at the converter input 126. Ideally, the converter 10 has a power factor of one, signifying a totally resistive circuit. In addition, the power factor controller 106 contributes to low total harmonic distortion at the inverter output 132 and a regulated voltage at the converter output 128. The regulated DC power from the power preregulator 105 is fed to the inverter 20.

The inverter 20 includes a lamp control circuit 109, a control input interface 122, a square-wave amplifier 112, a resonant circuit 124, a inhibiting means 114 for inhibiting unwanted resonance of the resonant circuit, and a step-up transformer 118.

The lamp control circuit 109 includes an oscillator controller 108, an oscillator 110, and a driver 111. The oscillator controller 108 controls the frequency of the alternating current (AC) output of the oscillator 110. The oscillator controller 108 may comprise an inverting operational amplifier circuit, a noninverting operational amplifier circuit, an error amplifier, or a differential amplifier circuit that provides a frequency-determining input to the oscillator 110.

The oscillator 110 preferably comprises a voltage-controlled oscillator (VCO) which generates a square wave form, a sinusoidal wave form, or a triangular wave form. Changes in the voltage input to the oscillator 110 yield corresponding changes in the oscillator frequency. The oscillator 110 is preferably capable of oscillating from 20 KHz to 100 KHz. In alternate embodiments of the oscillator, the oscillator frequency can be changed by varying capacitance, inductance, or both capacitance and inductance such that a resonant tank circuit for the oscillator is tuned.

The oscillator 110 is coupled to a driver 111. The driver 111 is optimally a commercially available half-bridge driver, a half-bridge transformer driver, or the like. Various drivers are commercially available as integrated circuits.

A half-bridge transformer driver has a primary winding and two secondary windings. The secondary windings have approximately equal turns. The two secondary windings are preferably wound in opposite directions to produce opposite phases at their outputs.

The control input interface 122 provides an interface to the lamp control circuit 109. The control input interface 122 allows a user to vary the oscillator frequency of the oscillator 110 via the oscillator controller 108. The control input interface 122 may comprise, for example, a potentiometer or a resistive divider incorporating a potentiometer.

The driver 111 has one or more driver outputs coupled to the square-wave amplifier 112. The square-wave amplifier 112 amplifies the oscillator signal from oscillator 110. A DC bus voltage from the converter output 128 provides power to the square-wave amplifier 112. The square-wave amplifier 112 is preferably a half-bridge configuration or a "half-bridge inverter". The output of the square-wave amplifier 112 is a square- wave. In alternate embodiments, the square-wave amplifier 112 may be a half-bridge circuit, a saturable-core transformer circuit, a push-pull, two transistor circuit, a full-bridge circuit, or a self-oscillating circuit.

The resonant circuit 124 is coupled to the output of the square-wave amplifier 112. The resonant circuit 124 comprises a first resonant element 116 and a second resonant element 120. A step-transformer 118 preferably intervenes between the first resonant element 116 and the second resonant element 120. The resonant circuit 124 is coupled to the lamp 30. The resonant circuit 124 limits current to the lamp 30 during the operational phase of the lamp 30.

An inhibiting means 114, for inhibiting unwanted resonance of the resonant circuit during the start-up mode, is coupled to the output of the square-wave amplifier 112. The inhibiting means 114 is used during the start-up mode of the lamp 30 to inhibit parasitic capacitances in the lamp fixture from oscillating with neighboring inductances or inductances associated with the resonant circuit 124. In practice, the inhibiting means 114 comprise high-speed clamping diodes.

The power output of the inverter 20 is best described by two temporally distinct modes. The first mode or start-up mode occurs when alternating current (AC) power from the inverter 20 is first applied to a lamp 30. The start-up mode is synonomous with the open-circuit state in which the lamp 30 is absent, disconnected, or inactive. The second mode or operational mode occurs subsequent to the start-up mode. The load state is synonomous with the operational mode in which the lamp 30 is active or emitting light. The start-up mode requires a greater AC voltage than the operational mode does.

Start-up Mode of the Inverter

The lamp control circuit 109, the inhibiting means 114, and the step-up transformer 118 perform significant functions during the start-up mode. Neither the oscillator controller 108, nor the control input interface 122 inherently restricts the oscillator 110 to a narrow frequency band or a particular frequency during the start-up mode. The oscillator 110 may operate at an arbitrary frequency during the start-up mode. However, for convenience the oscillator frequency during the start-up mode is preferably selected such that if the lamp 30 were in the operational mode, the oscillator frequency would produce the desired illumination of the lamp 30. Selecting the oscillator frequency in the preceding manner eliminates the attendant circuit complexities of changing oscillator frequency during the transition from start-up mode to operational mode.

The start-up mode utilizes a step-up transformer 118 to develop the necessary threshold voltage to start the lamp 30. The threshold start-up voltage is determined by the requirements of a particular type lamp. The lamp 30 comprises a gas-discharge lamp, a fluorescent lamp, or the like. During the start-up mode, the step-up transformer provides the necessary threshold voltage regardless of the oscillator frequency of the oscillator 110. In other words, if the oscillator frequency were to vary from its maximum frequency to its minimum frequency, the inverter 20 would still provide a sufficient output voltage at the inverter output 132.

During the start-up mode, the lamp 30 is initially treated as an open circuit at the inverter output 132. Consequently, no significant current initially flows through the complete resonant circuit 124 or the lamp 30. For example, the series capacitor of the resonant circuit 124 is electrically floating and does not contribute to the operation of the ballast circuit during the start-up mode. Because the resonant circuit 124 is nonresonant during the start-up mode, the amplitude of the start-up voltage depends primarily on the power factor controller 106 and the step-up ratio of the transformer 118.

The inhibiting means 114 is coupled to the output of the square-wave amplifier 112 via the first resonant element 116 of the resonant circuit 124. The inhibiting means 114 preferably comprises clamping diodes. During the start-up mode, the clamping diodes limit the voltages on the primary winding to values between the maximum DC bus voltage and the minimum (i.e. ground) DC bus voltage.

The inhibiting means 114 prevents energy from being stored in the resonant circuit 124. The inhibiting means 114 prevents potential parasitic capacitances in lamp fixtures from providing current to the resonant circuit 124. The inhibiting means 114 also prevents parasitic capacitances from resonating with the secondary windings of the step-up transformer 118. Because the inhibiting means 114 restricts voltages applied to the primary winding, the chances of oscillation in the secondary windings are reduced.

The open-loop circuit is inherently protected because no current flows through the entire resonant circuit 124 during the open-circuit state. Feedback circuits to compensate for frequency variation of the oscillator 110 are not required for the transition between start-up mode and operational mode.

Operational Mode of the Inverter

The lamp control circuit 109 and the resonant circuit 124 determine the lamp's luminance during the operational mode. The lamp control circuit 109 and the resonant circuit 124 act together to vary the load output voltage at the inverter output 132 in response to user input. As a result, a user may control the brightness of the lamp 30.

A user may operate the control input interface 122 to tune the oscillator 110 to a particular operational frequency. For example, a user may select a particular operational frequency by adjusting a potentiometer or operating a dimmer switch. A valid operational frequency falls within a range of frequencies over which the lamp's luminance can be varied from a maximum luminance to a minimum luminance.

During the operational mode, the oscillator controller 108 manipulates the oscillator frequency so that the resonant circuit 124 attenuates, increases, or stabilizes the inverter output voltage. If a series resonant circuit is used, the oscillator controller 108 moves the oscillator frequency above or below the resonant frequency to attenuate the inverter output voltage. In contrast, if a parallel resonant circuit were used, the oscillator controller would move the oscillator frequency toward the resonant frequency to attenuate the inverter output.

In the operational mode, the frequency versus attenuation response of the resonant circuit 124 determines the load output voltage of the inverter 20. A series resonant circuit has an inductor and a capacitor. The inductor primarily influences attenuation above the resonant frequency, while the capacitor primarily influences attenuation below the resonant frequency.

Illustrative Circuit of the Electronic Ballast

Figure 1B:
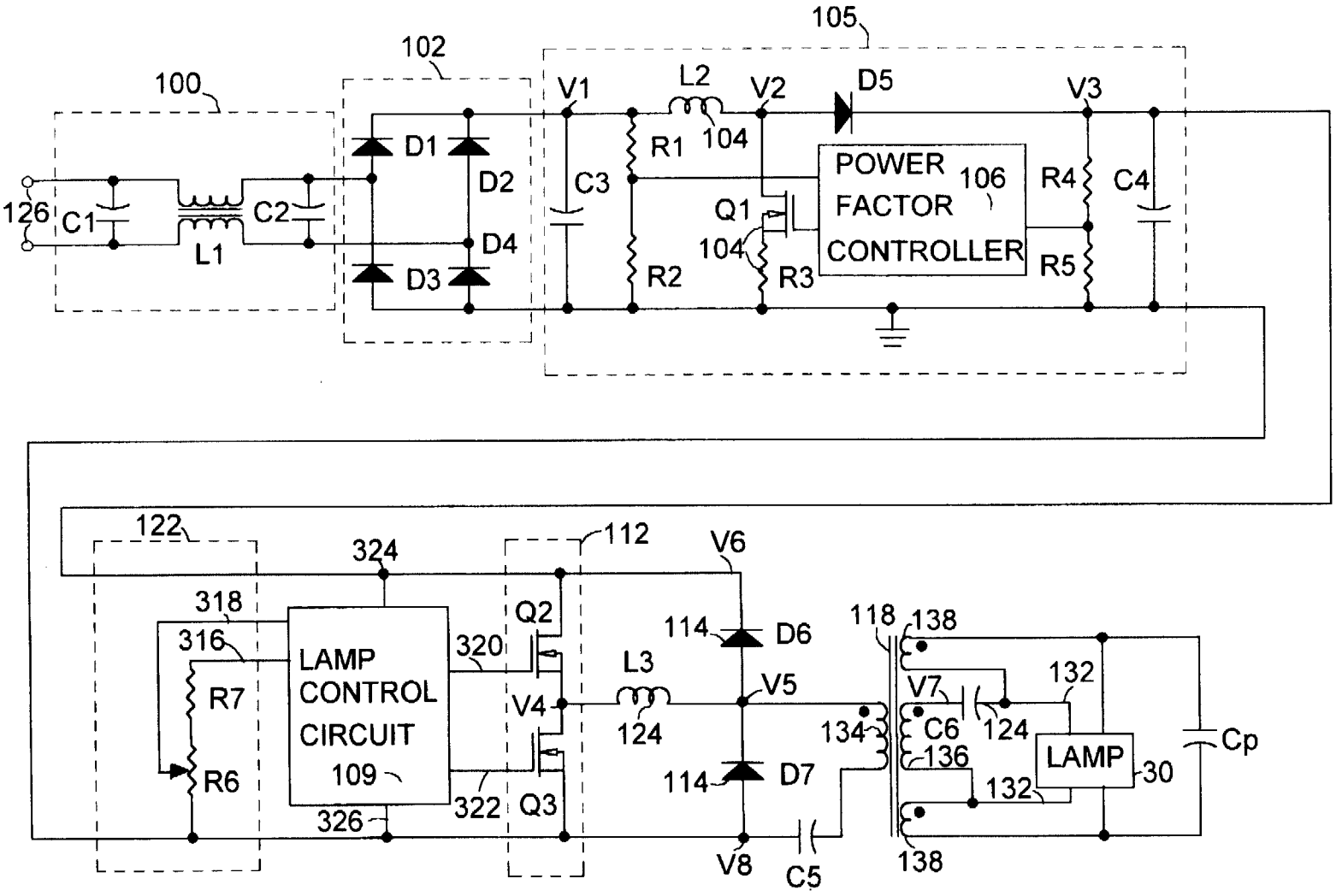
FIG. 1B is an illustrative schematic diagram corresponding to the general blocks shown in FIG. 1A.

FIG. 1B shows the block diagram of FIG. 1A in greater detail. Starting from the left side of the circuit, the line filter 100 filters AC power from the converter input 126 to reduce the voltage ripple at the line filter output under a wide assortment of current loads. The line filter 100 uses filter capacitors C1 and C2 in parallel across the line filter input and line filter output, respectively. The line filter 100 uses choke L1 in series with the line filter input.

The rectifier 102 is connected to the output of the line filter 100. Here, the rectifier 102 comprises a full-wave bridge rectifier and includes diodes D1, D2, D3, and D4. The diodes D1, D2, D3, and D4 are arranged to rectify the AC power from the line filter 100 and to provide DC power across filter capacitor C3. Filter capacitor C3 reduces voltage fluctuations in the DC power. Filter capacitor C3 may be an electrolytic capacitor.

The power preregulator 105 includes the power factor controller 106 and the voltage increasing circuit 104. The voltage increasing circuit 104 is connected to the rectifier 102 and in parallel with capacitor C3. The voltage increasing circuit 104 comprises an inductor L2 placed in series along the positive DC voltage bus or rail. Switch Q1 comprises an FET, a (metal-oxide-semiconductor) MOS transistor, a transistor, a semiconductor, or the like. Switch Q1 is activated by the power factor controller 106 at a frequency selected by the power factor controller 106. Here, the power factor controller 106 biases the gate of switch Q1.

Switch Q1 has a conductive state and a nonconductive state. In its conductive state, current flows through inductor L2, through the switch terminals of switch Q1, and through shunt resistor R3 to DC ground. If switch Q1 is a power field-effect transistor (FET) as illustrated, current flows from the drain to the source via the channel of the power field effect transistor. In the nonconductive state of switch Q1, current flows through the inductor L2 to diode D5.

Switching switch Q1 on and off, between the conductive state and the nonconductive state, produces current variations in inductor L2. The inductor L2 opposes the current variations and attempts to keep the current flowing. As a result, the inductor L2 develops voltage potentials across its terminals which are proportional to the current variations in the inductor L2. The voltage increasing circuit 104 produces a higher voltage at node V2 is than the voltage at node V1. Diode D5 is an isolating diode that eliminates negative transients from the DC wave form.

The power factor controller 106 is a commercially available power factor controller. Suitable power factor regulators are available through Motorola Semiconductor Products, P.O. Box 20912, Phoenix, Ariz. 85036. For example, Motorola manufactures a power factor controller under part number MC34262P. Another source for suitable power controllers is Linfinity Microelectronics, 11861 Western Ave., Garden Grove, Calif. 92641. Linfinity Microelectronics manufactures the LX1562 and LX1563 power factor controllers.

The power factor controller 106 shown in FIG. 2 is operated in the boost mode. Commercially available power factor controllers may also be operated in the buck, flyback, and buck-boost modes. Operating the power factor controller in the above modes is well known to those of ordinary skill in the art.

The main requirement of the power factor controller 106 is to generate a steady state DC voltage for a specified line voltage variation and maintain desirable power quality. Power quality includes high power factor at the converter input 126 and low total harmonic distortion of the input current. The power factor controller 106 senses the line voltage at node V2 and node V3 and accordingly biases Q1 with a pulse width modulated signal (PWM) for operation in the conductive and nonconductive states.

Resistor R1 and resistor R2 form a resistive voltage divider which provide a first voltage input to the power factor controller 106 prior to the voltage increasing circuit 104. The first voltage input is directly proportional to the DC voltage at node V1. Similarly, resistor R4 and resistor R5 form a resistive voltage divider that provides a second voltage input, or feedback voltage, to the power factor controller 106 after the voltage increasing circuit 104. The second voltage input is directly proportional to the DC voltage at node V3. The power factor controller 106 makes corrections in its control of switch Q1 based on processing of the first voltage input and the second voltage input.

Capacitor C4 filters the output of the power factor controller 106 by storing and discharging energy at appropriate times. The lamp control circuit 109 may be powered via capacitor C4. In practice, an interface, such as a resistive dividing network, is used to scale the voltage across capacitor C4 to appropriate levels for the lamp control circuit 109. Alternatively, a reference voltage source could be used to power the lamp control circuit 109.

The oscillator controller 108 includes variation means for varying the frequency of an oscillator 110 in response to a control input. The variation means may comprise an amplifier, or both an amplifier and an attenuator for adjusting the frequency-determining input of the oscillator 110. The output of the amplifier is coupled to the oscillator 110. The oscillator 110 preferably comprises a voltage controlled oscillator (VCO) that changes frequency in response to different applied input oscillator voltages.

In alternative embodiments, the variation means may comprise a variable capacitor for tuning the oscillator frequency, a variable coil for tuning the oscillator frequency, a tuned, ferrite-slug coil for tuning the oscillator frequency, one of multiple crystals selected by switches for tuning the oscillator, one of multiple resonant circuits selected by switches for tuning the oscillator, or the like.

The output of the oscillator 110 is coupled to a driver 111. The driver 111 is preferably a half-bridge driver, which is commercially available as an integrated circuit. The driver 111 outputs a pulse-width modulated wave form or an appropriate duty cycle for turning on and off switches Q2 and Q3. For example, the driver 111 may provide power to activate switch Q2 half the time and to activate switch Q3 the remaining half of the time. The switches are typically saturated when turned on. Switches Q2 and Q3 may comprise semiconductor switches, transistors, field effect transistors (FET's), metal oxide semiconductor transistors (MOS), or the like.

While the driver 111 preferably comprises an integrated circuit, a transformer driver may be used instead of an active device. If the driver comprises a transformer driver, the transformer driver has a single primary winding and two secondary windings of opposite polarity. A first secondary winding would be active one half of the time while the second secondary winding would be active the other half of the time. The first secondary winding would drive switch Q2, while the second secondary winding would drive switch Q3.

Switches Q2 and Q3 comprise a square-wave amplifier 112. The square-wave amplifier 112 may also be referred to as a "half-bridge inverter". However, for the purposes of this specification and the accompanying claims, "inverter" refers to inverter 20 of FIG. 1A rather than the square-wave amplifier 112.

The square-wave amplifier 112 obtains power from the DC bus. The output of the square wave amplifier 1 12 is at node V4. The output wave at inverter output 132 is preferably a low crest factor square wave.

The square-wave amplifier 112 amplifies the oscillator signal provided by the driver 111. Switches Q2 and Q3 are each exposed to the DC supply voltage at node V6. The output of switches Q2 and Q3 is a square wave whose peak value is equal to one-half of the DC supply voltage at node V6 or at node V8.

In an alternate embodiment, the square-wave amplifier can also utilize conventional bipolar junction transistors in a push-pull configuration. An additional transformer would be used with the bipolar configuration or the step-up transformer would need modification to accommodate the push-pull configuration. In a push-pull configuration, the collectors of the transistors are typically connected to two different primary windings of an output transformer. Meanwhile the emitters are biased by a DC source connected at common tap connection of the primary windings and the emitters.

The resonant circuit 124 includes a first resonant element 116 and a second resonant element 120. Here, the first resonant 116 element comprises inductor L3. The second resonant element 120 comprises capacitor C6. The capacitor C6 is selected based on current carrying requirements and the desired resonant frequency. The inductor L3 and the capacitor C6 form a series resonant circuit. The resonant frequency of the resonant circuit 124 is determined according to the following formula: $fr=1/(2\pi(LC)^{1/2})$, where fr is the resonant frequency in Hertz, L is the value of the inductor L3 in Henries, and C is the capacitance of the capacitor C6 in Farads.

Because the step-up transformer 118 is located between the inductor L3 and capacitor C6, the step-up transformer 118 may add some inductance and capacitance to the resonant circuit 124, which will cause deviation from the above, theoretical resonant frequency formula. Capacitance of the transformer 118 results from the insulation gap between the wire turns on the windings. However, the transformer 118 is predominately inductive.

During the start-up mode or in the absence of a lamp load, the capacitor C6 is electrically floating and optimally does not exchange any energy with the inductor L3. The inductor L3 tends to electrically float because, in theory, a high impedance upon the secondary winding 136 yields a high impedance at the primary winding 134. As a result, the current flow through inductor L3 is nominal during the start-up mode or open-circuit state.

The resonant circuit 124 limits the current flowing through the lamp 30 to appropriate values during the operational mode. Here, the resonant circuit 124 is a series resonant circuit. A series resonant circuit, attenuates the load output voltage at inverter output 132 in response to increases in the oscillator frequency with respect to the resonant frequency.

The series resonant circuit provides an appropriate lamp current crest factor. In alternate embodiments, the series resonant circuit could be replaced by an inductor or active current limited switches to obtain appropriate current characteristics according to methods which are well known to those of ordinary skill in the art.

An inhibiting means 114 for inhibiting unwanted resonance of the resonant circuit comprises clamping diodes, high-speed switching diodes, semiconductor junctions, appropriately biased transistors, or the like. For example, in FIG. 1B the inhibiting means 114 comprises a first clamping diode D6 and a second clamping diode D7. The first clamping diode D6 and the second clamping diode D7 act as commutation diodes. The first clamping diode D6 and the second clamping diode D7 must have sufficiently rapid recovery characteristics to enable the circuit to be driven at the highest desired oscillator frequency.

If the first semiconductor switch Q2 is a field-effect transistor as shown in FIG. 1B, the cathode of the first clamping diode D6 is connected to the drain of the switch Q2 and the anode of the first clamping diode D6 is coupled to the source of the switch Q2 via inductor L3. Similarly, if the second semiconductor switch Q3 is a field-effect transistor, the anode of the second clamping diode D7 is connected to the source of the switch Q3 and the cathode of the second clamping diode D7 is coupled to the drain of the switch Q3 via the inductor L3.

During the start-up mode or no-load state, the first clamping diode D6 and the second clamping D7 prevent the inductor L3 from storing square wave signals having amplitudes exceeding the positive DC bus voltage or falling below the negative DC bus voltage. The first clamping diode D6 limits the maximum voltage at node V5 to the positive DC bus voltage. The second clamping diode D7 limits the lowest voltage at node V5 to the negative DC bus voltage or to ground.

The inhibiting means 114 decreases the chances of unwanted oscillation of the resonant circuit 124 and in the secondary transformer circuit of step-up transformer 118 during the start-up mode. Unwanted resonant operation can cause serious damage to the inverter when the oscillator frequency is varied without any feedback. In practice, when the lamp 30 is inactive or disconnected, a parasitic capacitance CP may develop between the lamp fixture and the power leads.

Diodes D6 and D7 inhibit the resonant circuit from resonating during the start-up mode. Diodes D6 and D7 inhibit the storing of energy in inductor L3, which forms part of the resonant circuit. In addition, diodes D6 and D7 may prevent the principal secondary winding 136 of the step-up transformer 118 from acting as a ferro-resonant transformer in conjunction with the parasitic capacitances CP.

Parasitic capacitances CP may exist between a metallic lamp fixture and its associated power leads. The parasitic capacitance CP is in parallel with the lamp 30 and can cause current to flow in transformer secondary circuit even when the lamp is turned off. The parasitic capacitance CP is sometimes as high as 1 nanofarad in certain fluorescent light fixtures. The parasitic capacitance CP in FIG. 1B is not a deliberate or intentional addition of a commercially available capacitor to the circuit. Rather, the parasitic capacitance CP represents the potential, unwanted capacitance arising from the geometry of actual lamp fixtures.

During the operational mode or load state, the first clamping diode D6 and the second clamping diode D7 are generally reversed biased. However, the diodes D6 and D7 may be forward biased for limiting the inverter output voltage during peak luminance of the lamp. If the oscillator frequency exceeds the resonant frequency of the resonant circuit 124, the impedance of the inductor L3 increases such that diodes D6 and D7 are reverse biased. Therefore, in the operational mode, the diodes D6 and D7 may have no affect on the voltage at node V5 depending upon the oscillator frequency, the inductance of the inductor L3, and reactance of the inductor L3.

In other words, if the oscillator frequency exceeds the resonant frequency of the resonant circuit 124, the impedance of inductor L3 may attenuate the square wave signal at the node V5 such that the signal at node V5 is less than the signal at node V4. The attenuation occurs because of characteristic impedance response of the inductor L3. The higher the oscillator frequency, the less likely diodes D6 and D7 are likely to conduct or limit the output signal.

A step-up transformer 118 with a primary winding 134 is coupled to the output node V5. The primary winding 134 is connected the inductor L3. Leakage inductance spikes are dissipated in capacitor C5 which is located in series with the primary winding 134. Capacitor C5 and the primary winding inductance are optimally selected so that they do not form a resonant circuit across the operational frequency range of interest.

The step-up transformer 118 has a primary winding 134 and a plurality of secondary windings. The dots indicate the point where alternating current in the primary windings 134 and secondary windings are in phase. The secondary windings include a principal secondary winding 136 and heater secondary windings 138.

During the start-up mode, the principal secondary winding 136 is used to step-up the voltage from node V5 to meet or exceed a threshold start-up voltage. The startup voltage is proportional the ratio of turns of the primary winding 134 to the principal secondary winding 136. The heater secondary windings 138 are lower resistance and lower voltage windings than the principal secondary winding 136. The heater secondary windings 138 are for heating the lamp electrodes and/or cathodes to emit electrons.

The output voltage of the inverter 20 during the start-up mode is governed by the following formula: $V_S=V_P(N2/N1)$, where N2 is the number of turns in the principal secondary winding 136, N1 is the number of turns in the primary winding, $V_P$ is the input voltage to the primary winding 134, and $V_S$ is the output of the secondary winding 136. For example, if the primary voltage ($V_P$) is 100 VRMS and if 300 VRMS are required for the starting voltage of the lamp, the required ratio of N2/N1 is three.

Capacitor C5 and capacitor C6 prevent DC current from flowing through the primary winding 134 and the principal secondary winding 136, respectively. The resonant circuit 124 is preferably split-up to prevent the direct current (DC) rectifying effect of the lamp 30. The rectifying effect occurs during a partial failure mode of the lamp 30. In the partial failure mode, the lamp 30 can act as a diode in series with a resistor if one electrode fails.

The lamp 30 may comprise a fluorescent lamp, a hot-cathode electrode lamp, a preheated hot-cathode electrode lamp, a cold-cathode lamp, or the like. The voltage drops across lamp electrodes vary with the lamp type and construction. For example, hot-cathode lamps typically have a voltage drops of 14–20 volts across the electrodes. Meanwhile, cold-cathode lamps have a voltage drop of 90–130 volts between the electrodes. The secondary of the transformer is designed to accommodate voltage the electrode voltage drop of the corresponding lamp.

Lamp Control Circuit

Figure 1C:
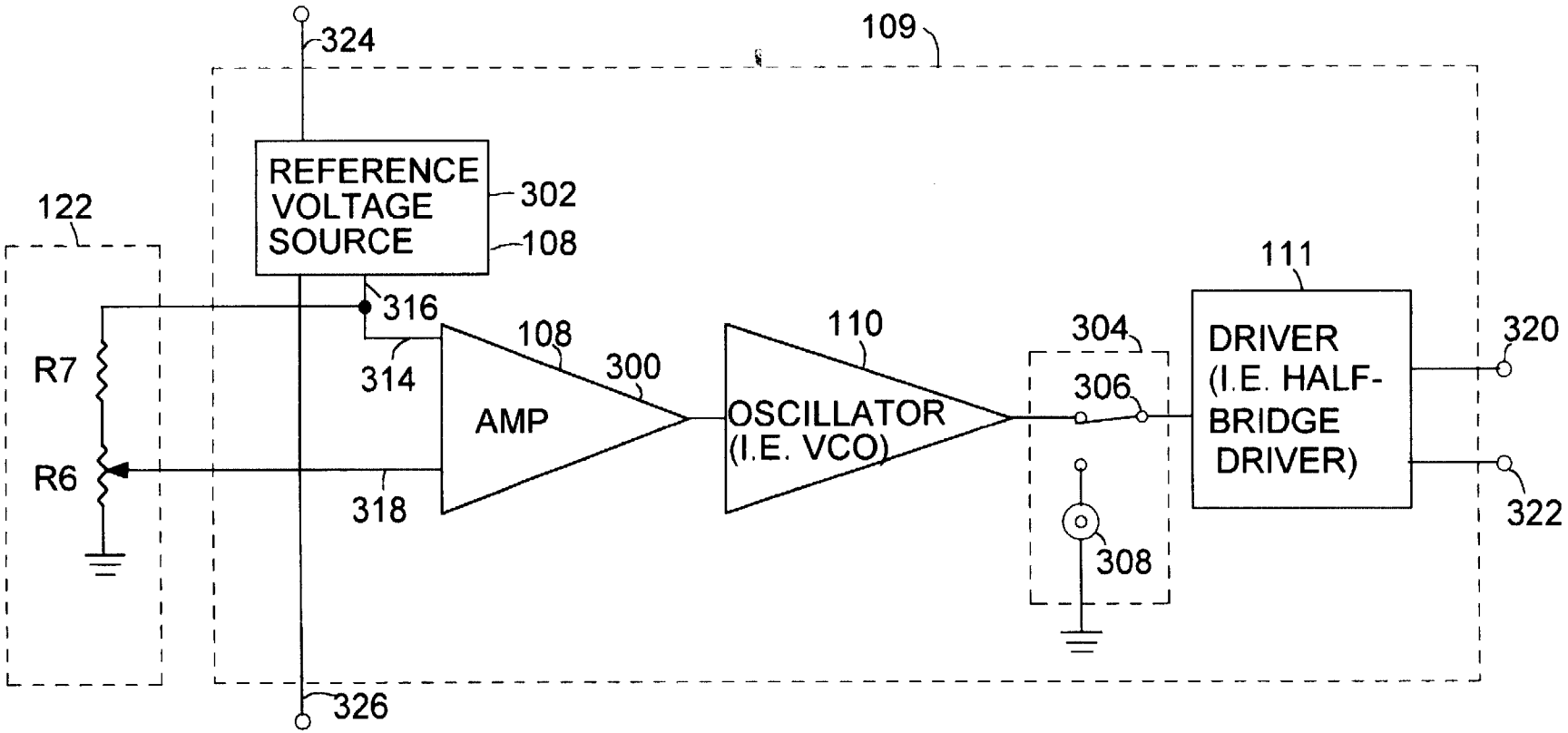
FIG. 1C shows a lamp control circuit and a control input interface in more detail than FIG. 1B does.

FIG. 1C shows the lamp control circuit 109 and a first embodiment of the control input interface 122. The lamp control circuit 109 includes an oscillator controller 108, a an oscillator 110, and a driver 111. The oscillator controller 108 may include an amplifier, an inverting operational amplifier, a variable gain amplifier, a noninverting operational amplifier, a differential amplifier, an error amplifier, or the like. Here, the oscillator controller 108 includes error amplifier 300 and a reference voltage source 302.

The error amplifier 300 has a reference input 314 and a control input 318. The reference input 314 is connected to the reference voltage source 302. The control input 118 of the amplifier 300 connected to the control input interface 122.

The control input interface 122 comprises a resistive voltage divider circuit, which includes a potentiometer or variable resistor R6 and resistor R7. Resistor R6 and R7 are connected in series between the reference voltage source output 316 and DC ground. The wiper of potentiometer R6 is coupled to the control input 118. A user may adjust potentiometer R6 to change the output voltage of the error amplifier 300.

The output control signal of the error amplifier 300 is sent to the oscillator 110. The error amplifier 300 preferably works in the differential mode to provide output voltages which are proportional to a desired oscillator frequency of the oscillator 110. The output of the error amplifier 300 is connected directly to the oscillator 110 or coupled to the oscillator via variation means for varying the frequency of the oscillator.

The error amplifier 300 yields a variable output voltage or current through variable gain, variable amplifier feedback, variable input power or by other techniques, which are well known to those of ordinary skill in the art. For example, the amplifier 300 may be embodied as an operational amplifier in an inverting configuration. The inverting configuration has an input resistor coupled to the inverting input of the operational amplifier. The noninverting input of the operational amplifier is coupled to the reference voltage source 302. A feedback resistor is connected between the operational amplifier output and the inverting input. The inverting input would be connected to the wiper of the resistor R6. The ratio of the feedback and input resistor determine the gain of the inverting amplifier.

The reference voltage source 302 preferably derives its power from the positive DC power connection 324 and the negative DC power connection 326. The reference voltage source 302 may divide, sale and/or regulate the power from the positive DC power connection 324 and the negative DC power connection 326. The reference voltage source 302 may provide any constant, predetermined DC voltage reference value or DC ground for the amplifier reference input. The reference voltage source may also supply necessary DC biasing voltages to the error amplifier 300, the oscillator 110, and the oscillator controller 108.

The oscillator frequency of the oscillator 110 is preferably determined by the control output signal from the error amplifier 300. The oscillator is preferably a commercially available voltage controlled oscillator (VCO). The oscillator 110 produces an alternating current signal, such as a sinusoidal wave, a triangular wave, or a square wave, at the oscillator frequency.

The lamp control circuit 109 has an optional, auxiliary oscillator input 304. The optional auxiliary oscillator input 304 is shown as dashed lines in FIG. 1C to indicate that the auxiliary oscillator input 304 is strictly optional. The optional auxiliary oscillator input 304 includes an oscillator bypass switch 300 and an auxiliary oscillator input terminal 308. The oscillator bypass switch 306 is illustrated as a simple single-pole switch. However, in practice, the oscillator bypass switch 306 may comprise a multiple-pole, multiple-throw switches and a load resistor. The load resistor provides a dummy load for the oscillator 110 and prevents damage to the oscillator 110.

Figure 2A:
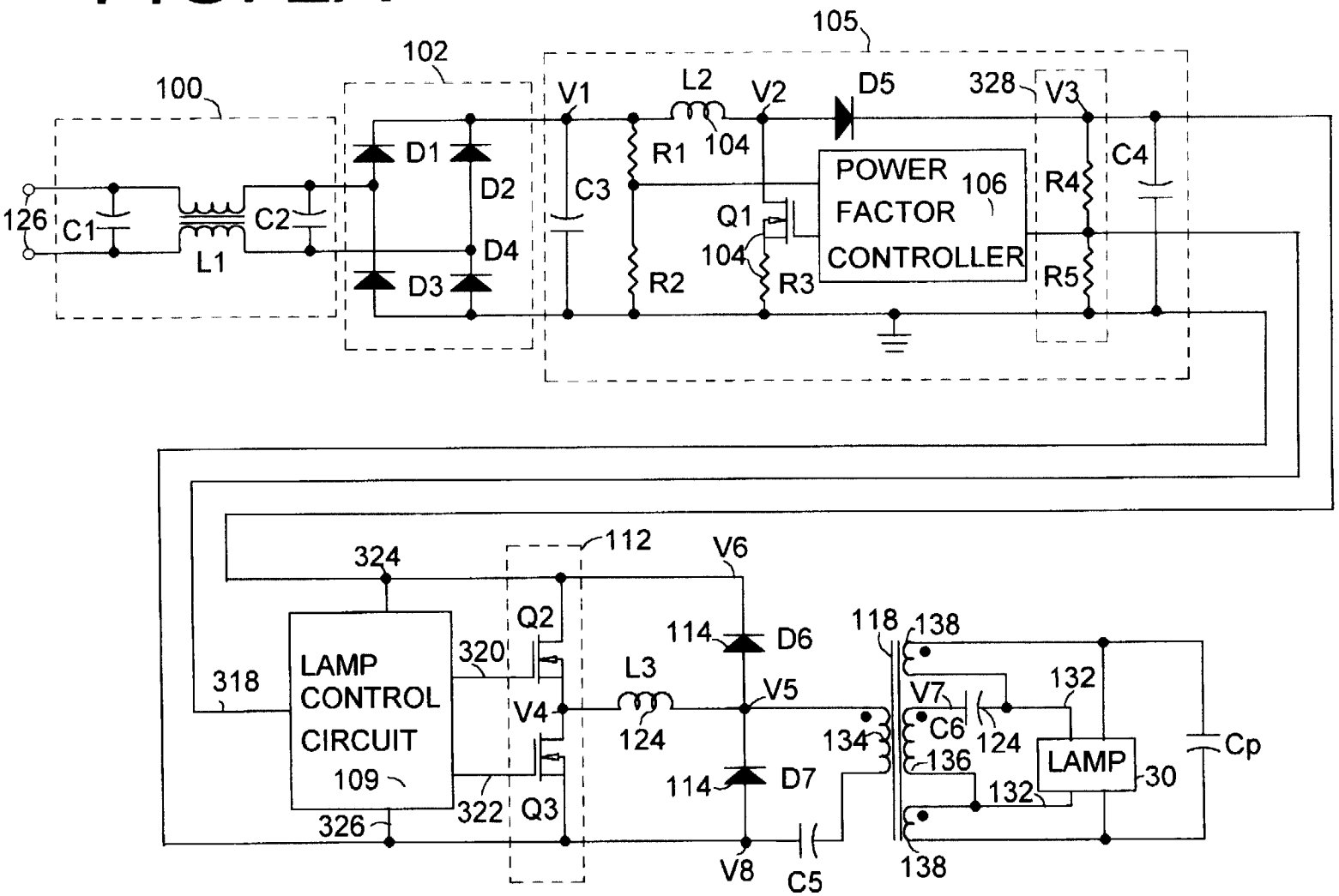
FIG. 2A is a schematic diagram of a second embodiment of the electronic ballast of the present invention.
Figure 2B:
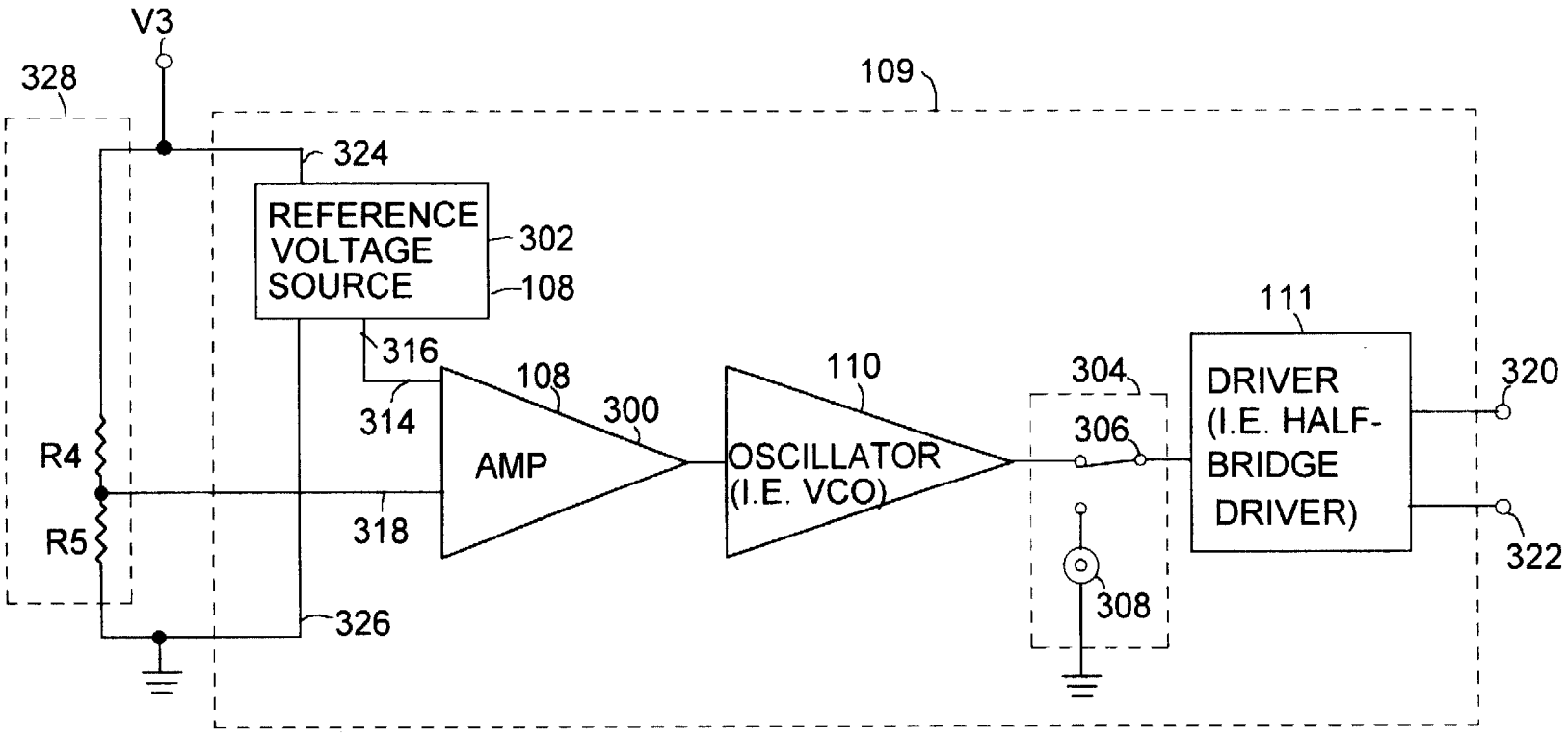
FIG. 2B shows the lamp control circuit and a second embodiment of the control input interface in more detail than FIG. 2A does.

FIG. 2A and FIG. 2B show the lamp control circuit 109 with a second embodiment of the control input interface 328. The control input interface 328 accepts a feedback voltage from the resistive divider that includes resistor R4 and resistor R5. While a separate resistive divider could have been used rather than reusing resistor R4 and resistor R5, sharing the resistive divider with the power factor controller 106 is feasible. The control input interface 328 takes voltage from the node where resistor R4 and resistor R5 are connected. The control interface couples the node to the control input 318 of the error amplifier 300.

The error amplifier 300 has a control input 318 and reference input 314. The amplifier amplifies the difference between the control input voltage and the reference input voltage by a predetermined gain. The control output of the error amplifier 300 is selected to change the frequency of the oscillator 110 to compensate for fluctuations at the control input 318.

For example, the oscillator controller 108 may use the error amplifier 300 to increase the frequency of the oscillator 110 in response to higher voltages at node V3 to compensate for input power fluctuations at converter input 126. Increasing the oscillator frequency relative to the resonant frequency of the series resonant circuit 124 decreases the brightness of the lamp 30. Therefore, even though fluctuations in the input voltage tend to cause brighter emission from the lamp 30, the oscillator controller 108 and the control input interface 328 can compensate so that the lamp 30 emits a constant level of light and does not flicker.

Figure 3A:
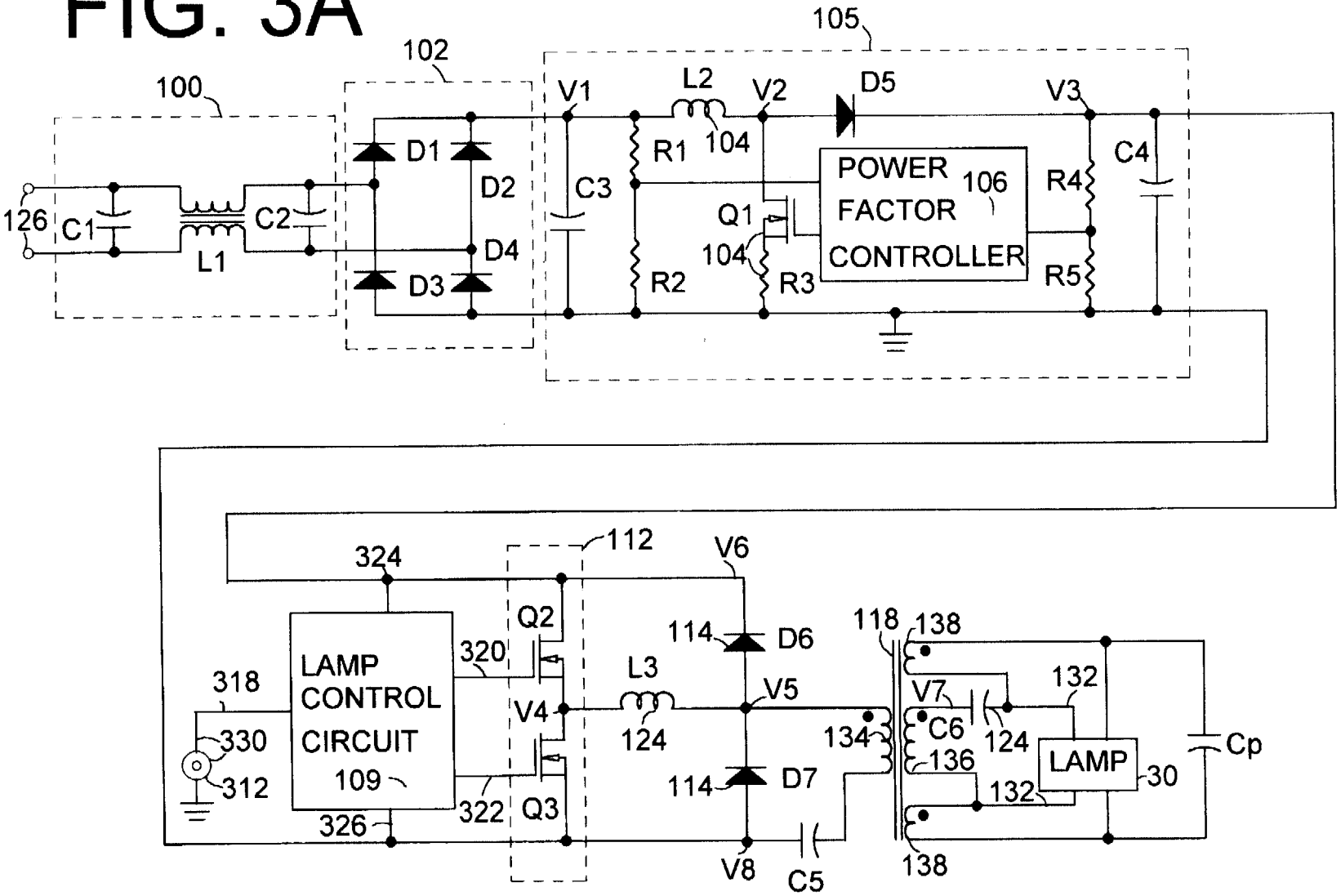
FIG. 3A is a schematic diagram of a second embodiment of the electronic ballast of the present invention.
Figure 3B:
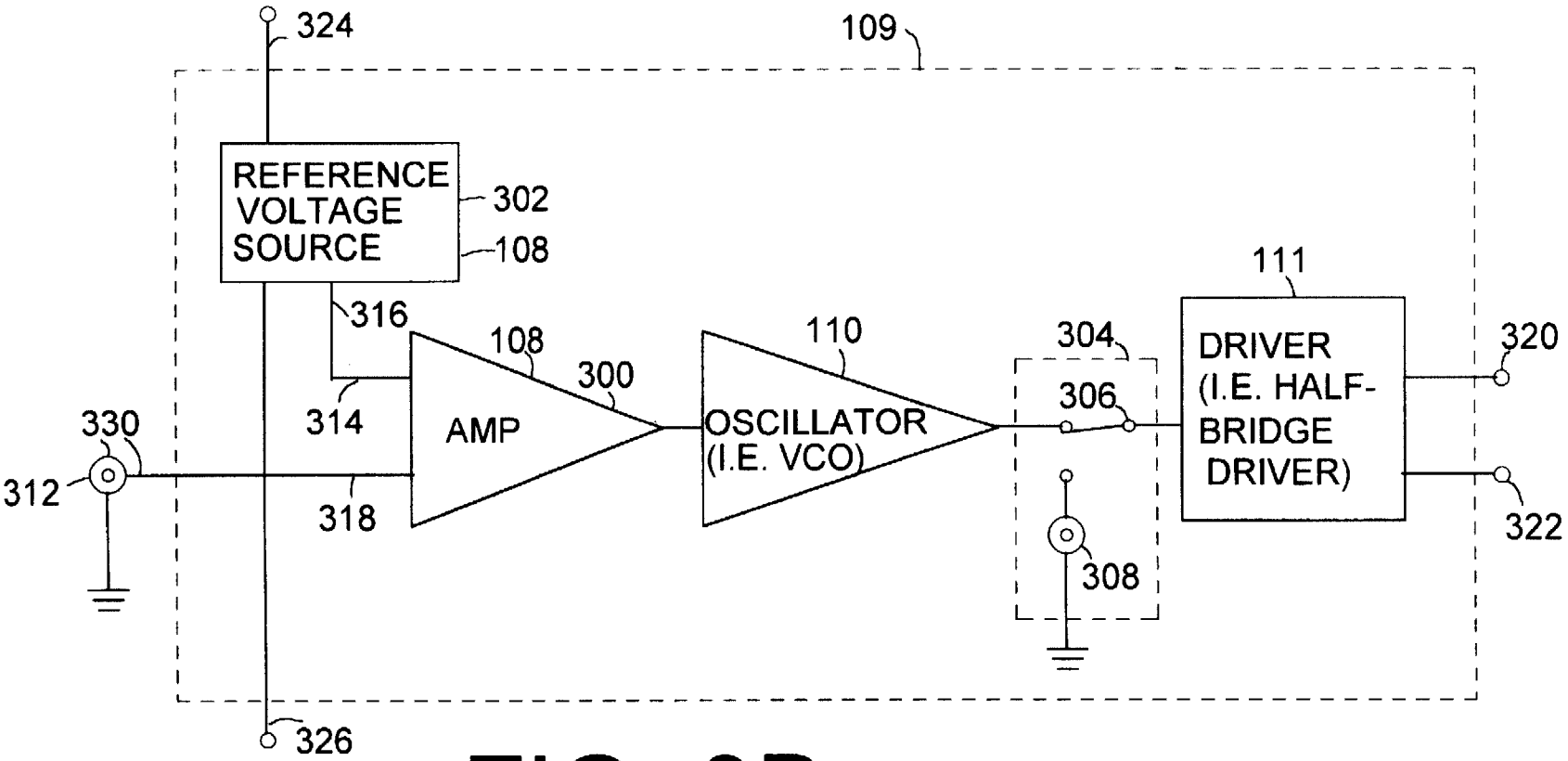
FIG. 3B shows the lamp control circuit and a third embodiment of the control input interface in more detail than FIG. 3A does.

FIG. 3A and FIG. 3B show the lamp control circuit 109 with a third embodiment of the control input interface 330. The error amplifier 300 has a control input interface 330 connected to the amplifier control input 318. A reference voltage output 316 is coupled to the reference voltage input 314. The control input interface 330 accepts voltage input from an external voltage source at control input terminal 312. The control output of the error amplifier 300 is connected to a frequency-determining input of the oscillator 110.

In practice, the external voltage source comprises a standard, commercially available control, such as a daylight sensor, an occupancy sensor, a wall-dimming switch, a dimmer, or the like. The control input interface 330 can accept voltages over virtually any predefined range. For example, the control input interface 330 could accept input voltages from 0 volts to 10 volts DC. The control input interface 330 may optionally use amplification or attenuation to yield an acceptable input for the error amplifier 300 or means for varying the frequency of the oscillator.

Electronic Ballast for Multiple Lamps

Figure 4A:
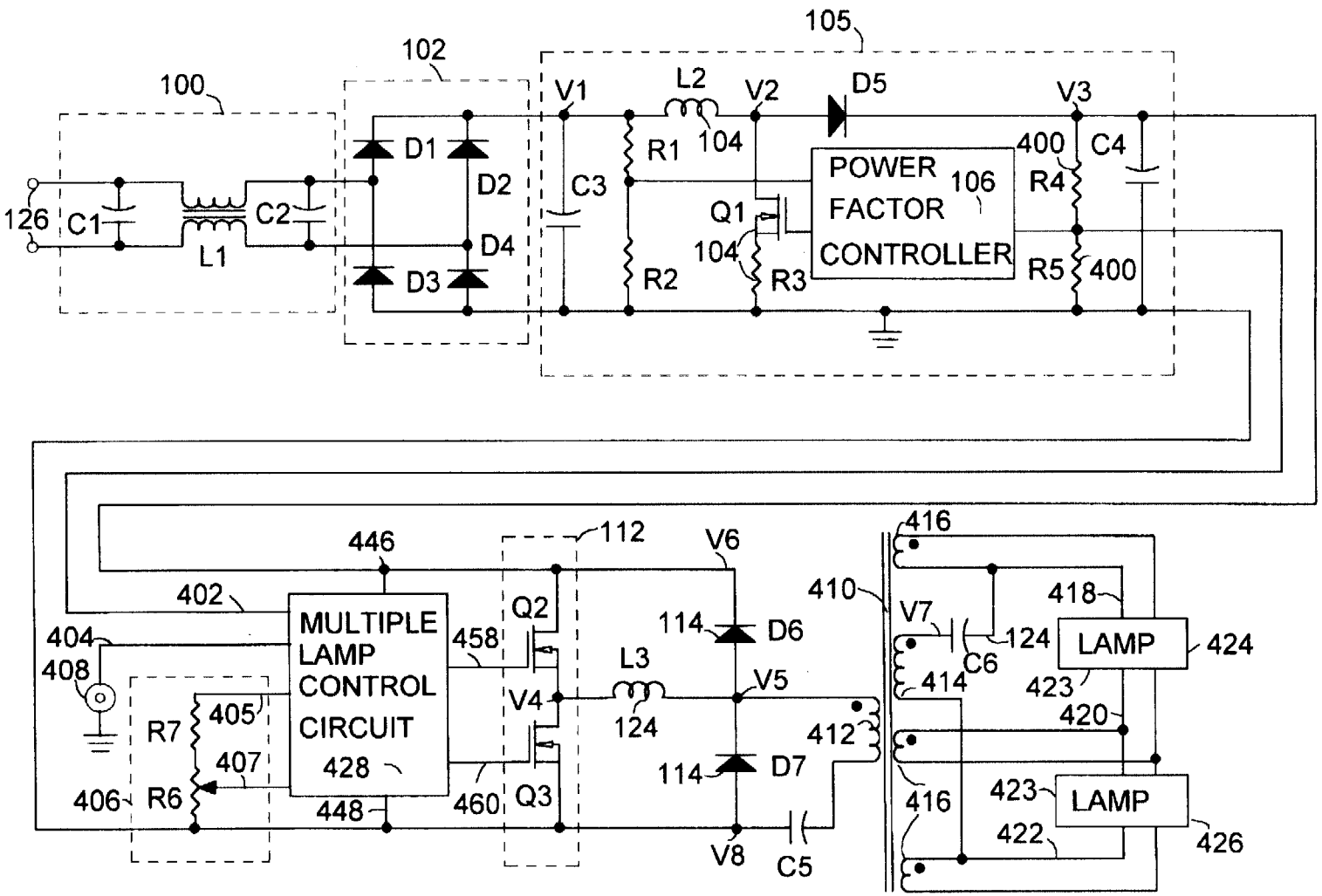
FIG. 4A is a schematic diagram of a fourth embodiment of the electronic ballast of the present invention.

FIG. 4A is an alternative embodiment of the inverter used to power multiple lamps. The inverter of FIG. 4A has a multiple input lamp control circuit 428, which is described in FIG. 4B in more detail. The transformer 410 has a primary winding 412 and a plurality of secondary windings.

The secondary windings are used to energize two gas-discharge (i.e. fluorescent) lamps. The secondary windings include the principal secondary winding 414 and heater secondary windings 416. The gas-discharge lamps 423 are wired in series with the principal secondary winding 414. The principal secondary winding 414 has a greater number of turns than the primary winding 412 to yield a suitable start-up voltage potential between a first secondary connection 418 and a second secondary connection 422. The ratio of turns of the primary winding with respect to the principal secondary winding is selected as previously described in conjunction with FIG. 1B.

A first lamp 424 is connected to the first secondary connection 418 and to a second lamp 426 via a jumper conductor 420. Similarly, the second lamp 426 is connected to the second secondary connection 422 and the jumper conductor 420. The heater secondary windings 416 are connected to the electrodes of the first lamp 424 and second lamp 426. Each heater secondary winding 416 has a lower voltage potential and lower resistance than the principal secondary winding 414.

During the operational mode the lamps 423 are energized in series. The resonant circuit 124 now controls the current and voltage to both lamps 423. The brightness of both lamps 423 is controlled simultaneously by adjusting the oscillator frequency of the oscillator through the oscillator controller as previously described in conjunction with FIG. 1A through FIG. 1C.

Figure 4B:
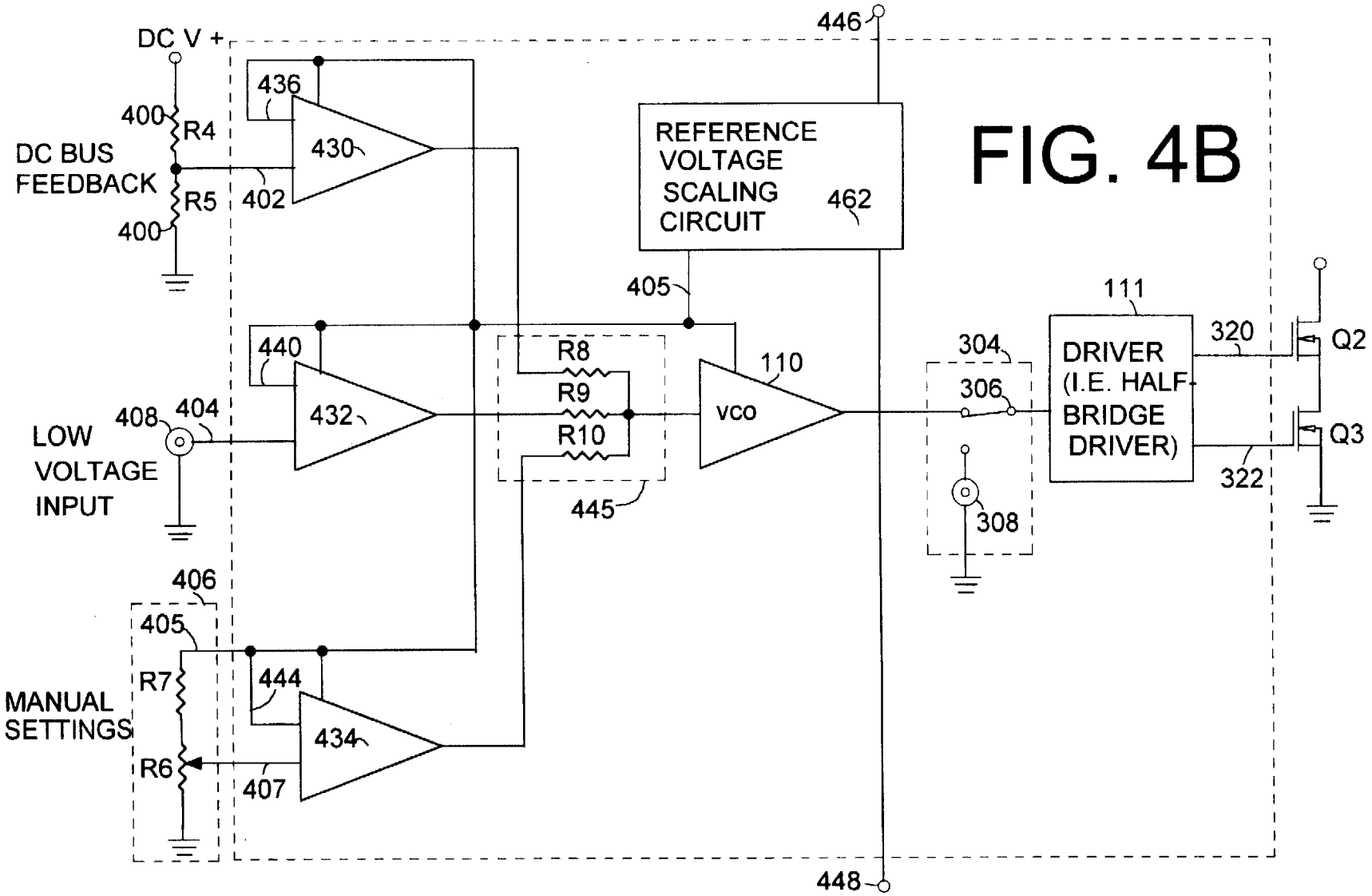
FIG. 4B shows the lamp control circuit and corresponding control input interfaces in more detail than FIG. 4A does.

In the illustrative embodiment of FIG. 4B, the multiple lamp control circuit 428 has three different control inputs associated with three corresponding amplifiers. Each amplifier amplifies a signal its control input with reference to its reference input. The output of each amplifier is coupled to the selection means 445 for selecting one of the three amplifiers. The selection means 445 couples a selected one of the three amplifiers to the oscillator 110. The output of the selected amplifier determines the frequency of the oscillator 110 as well as the brightness of the lamps 423.

The control inputs and amplifiers include a first control input 402 associated with a first amplifier 430, a second control input 404 associated with a second amplifier 432, and a third control input 407 associated with a third amplifier 434. The control inputs receive input signals from a first control interface 400, a second control interface 408, and a third control interface 406.

The first control input 402 accepts a DC feedback voltage to maintain constant luminance during input power fluctuations. The second control input 404 accepts a variable voltage source (i.e. a dimmer switch) that enables a user to manually control the brightness of the lamps 423. The third control input 407 accepts the output of a resistive divider circuit which is powered by the reference voltage circuit 462. The resistive divider includes a potentiometer to adjust the brightness of the lamps.

The first amplifier 430 has a first reference input 436. Any signal at the first control input 402 is amplified with respect to the first reference input 436. The first control input 402 accepts a feedback voltage from the first control interface 400. The first control interface 400 comprises a resistive divider, which has resistor R4 and resistor R5.

The first amplifier 434 and the first reference input 402 compensate for input power fluctuations at the inverter input 126. The first amplifier 430 increases the oscillator frequency in response to higher voltages at node V3 to compensate for input power fluctuations at the inverter input 126. Conversely, the first amplifier 430 may tune the oscillator frequency to approach the resonant frequency in response to lower voltages at node V3.

If the oscillator frequency is increased relative to the resonant frequency of a series resonant circuit, the lamps' luminance decreases. Likewise, as the oscillator frequency is tuned closer to the resonant frequency, the lamps' luminance increases. Therefore, even though fluctuations in the input voltage tend to cause erratic luminance from the lamps 423, the first amplifier 430 and the first control input 402 can compensate so that the lamps 423 emit a constant level of light and do not flicker.

The second amplifier 432 has a second reference input 440. Any signal at the second control input 404 is amplified with respect to the second reference input 440. The second control input 404 accepts voltage inputs from a standard commercially available control, such as a daylight sensor controlled source, an occupancy sensor controlled source, a wall dimming switch, a dimmer, and the like. The second control interface 408 is merely a terminal, jack, plug, or the like for connecting a commercially available control.

In practice, the second control input 404 can accept voltages over virtually any predefined range. For example, the second control input 404 could accept input voltages from 0 volts to 10 volts DC. The second amplifier 432 provides a fixed degree of amplification to scale the second control input 404 to an appropriate amplitude for the oscillator 110. In alternate embodiments, the second amplifier 432 may interface variation means for varying the oscillator frequency associated with oscillator 110.

The third amplifier 434 has a third reference input 444. Any signal at the third control input 407 is amplified with respect to the third reference input 444. The third control input 407 receives an input voltage from the third control interface 406.

The third control interface 406 is a resistive divider formed by the potentiometer R6 and resistor R7. The resistor R7 is coupled to the reference voltage output 405 of the reference voltage circuit 462. The wiper of potentiometer R6 is coupled to the third control input 407. The user can manually adjust resistor R6 to vary the output signal at the third amplifier 434. The output of the third amplifier 434 is selectively coupled to the oscillator 110 or variation means for varying the oscillator frequency.

The lamp control circuit 428 includes selection means 445 for selecting one of the amplifiers. The selection means 445 preferably comprises an analog OR logic circuit. The analog OR circuit consists of resistors R8, R9, and R10 placed in series with the amplifier outputs. The highest output voltage of the three amplifiers predominates with the analog OR circuit.

Alternatively, the selection means comprises a switching circuit to select the output of the first amplifier 430, the second amplifier 432, or the third amplifier 434. A user manually selects one of the amplifiers via the switching circuit. The switching circuit couples a selected one of the amplifiers to the oscillator 110. The oscillator 110 is preferably a voltage controlled oscillator so that the oscillator frequency is determined by the voltage from the selected amplifier.

The switching circuit optimally comprises a first switch associated with a first load resistor and a second switch associated with a second load resistor. The first switch and the second switch comprise two double-pole, double-throw switches configured in tandem. The first switch and the second switch cooperatively act to connect the oscillator with the first amplifier, the second amplifier, or the third amplifier. The first load resistor or the second load resistor terminates the nonselected amplifiers to prevent damage or spurious oscillation. The first switch and the second switch may comprise contact switches, relays, semiconductors, transistors, or the like.

Inverter Output Voltage Response

Figure 5:
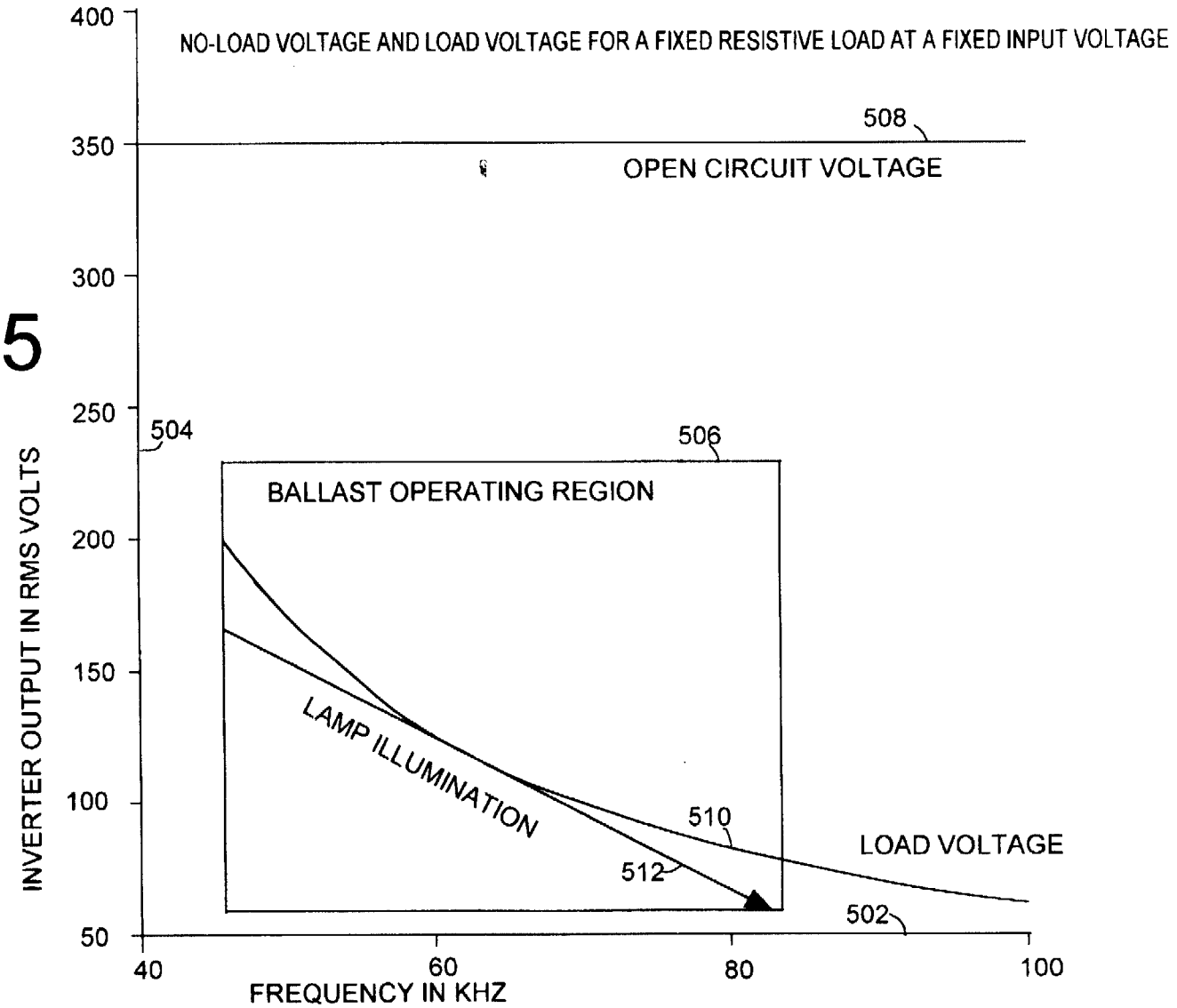
FIG. 5 is a graph showing that the open-circuit output voltage of the inverter during the start-up mode is constant regardless of the oscillator frequency and that the load output voltage of the inverter declines with increasing oscillator frequency, to dim the lights during the operational mode.

FIG. 5 shows the operation of the electronic ballast of the present invention during the start-up mode (i.e open-circuit mode) and the operational mode (i.e. load mode). The graph of FIG. 5 shows oscillator frequency 502 on the horizontal axis versus inverter output voltage 504 on the vertical axis. The graph also shows the normal ballast operating frequency region 506 ranges from approximately 45 KHz to 85 KHz. In practice, the operating frequency region 506 may extend from 30 KHz to 100 KHz depending upon component selection and design objectives.

During the startup mode, the inverter output voltage has an open-circuit, voltage output response 508. The open-circuit voltage output response 508 is constant with respect to the oscillator frequency 502. The open-circuit, voltage output response 508 resembles the response of a standard, linear resistor. In the illustrative embodiment the oscillator frequency 502 ranges from 40 KHz to 100 KHz, while the open-circuit voltage response 508 remains at approximately 350 volts, root-mean-squared (VRMS). For example, the constant open-circuit voltage is available via the transformer 118 of FIG. 1A.

During the operational mode or the load mode, the inverter output voltage declines with increasing oscillator frequency 502 as illustrated by the load voltage response curve 510. The lamp illumination ranges from approximately 100% at 45 KHz to zero at 85 KHz as illustrated by lamp illumination line 512. The declining inverter output voltage 504 is available via the resonant circuit 124, which attenuates the output with increasing oscillator frequency 502 and increasing deviation from the resonant frequency of the resonant circuit 124.

The inverter of the present invention can supply different load power outputs while maintaining a steady, reliable start-up or starting voltage. The inverter can be used on a variety of lamps if the lamp's minimum starting voltage falls within the design starting voltage and if the lamp's required load power is less than the maximum design power of the inverter.

For example, if the inverter has a maximum design power of 40 Watts, the inverter can support a wide variety of lamps, including the following: (a) a one and one-half inch diameter, four foot long, 40 watt lamp (i.e. F40T12 lamp); (b) a one inch diameter, four foot long, 32 watt lamp (i.e. F32T8 lamp); (c) a one inch diameter, three foot long 25 Watt lamp (i.e. F25T8 lamp); (d) a one inch diameter, two foot long, seventeen watt lamp (i.e. (F17T8); (e) a twin-tube, compact 40 watt fluorescent lamp (i.e. F40BX). The electronic ballast of the present invention can be used regardless of the user's switching from one type of lamp to another. Advantageously, the user does not need to purchase a new ballast when switching from one type of lamp to another if the lamp fits within the broad design parameters of the electronic ballast.

Figure 6A:
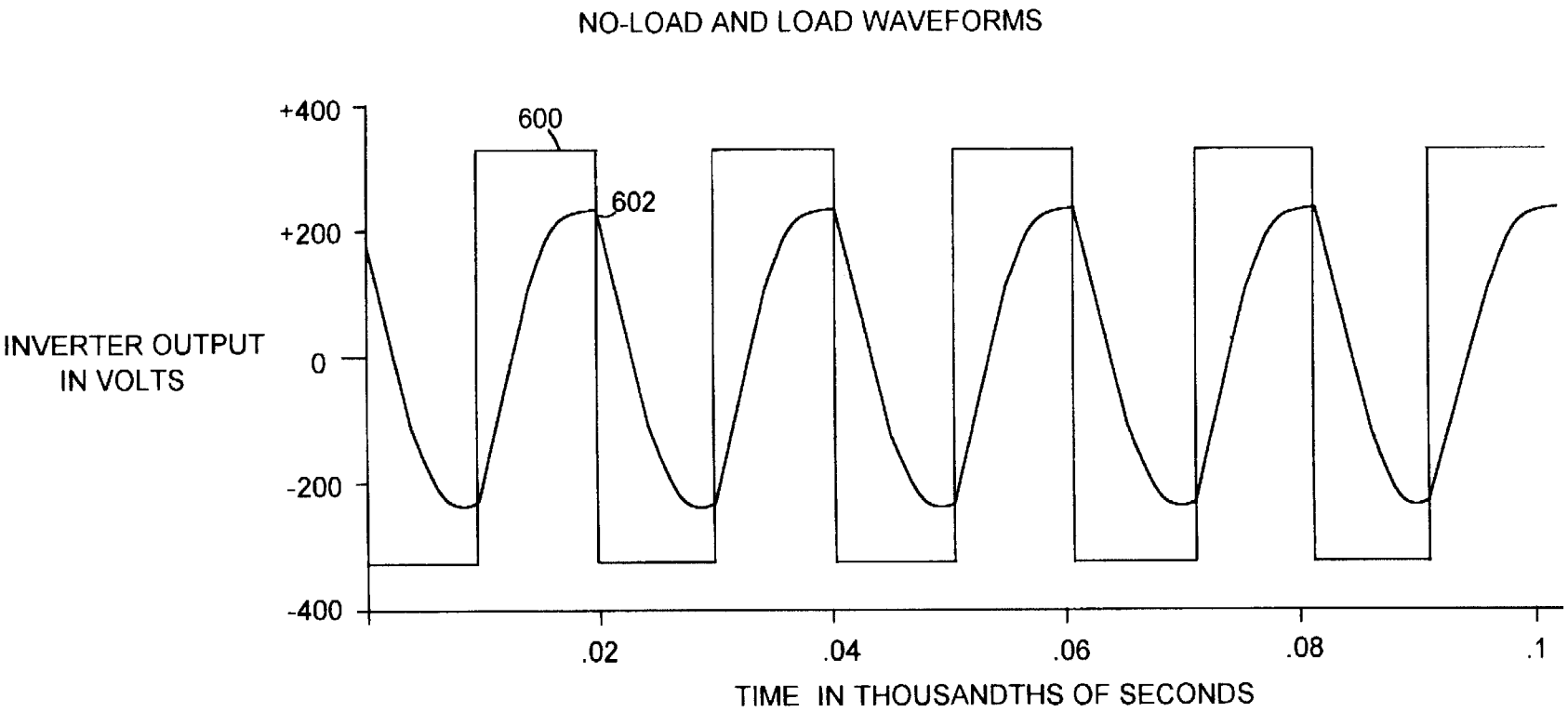
FIG. 6A is a graph of an open-circuit, square wave during the start-up mode and a load wave form during the operational mode at a first frequency.
Figure 6B:
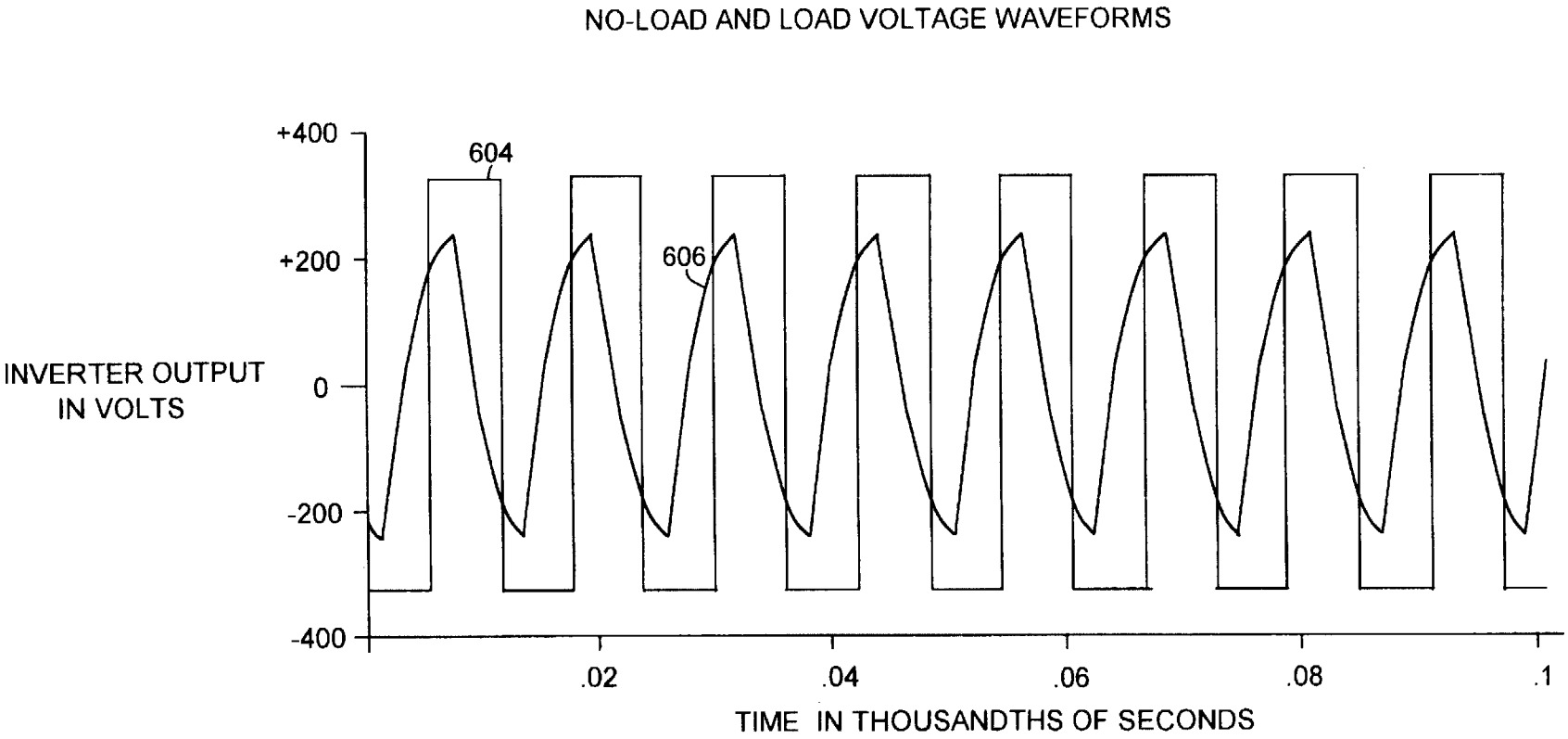
FIG. 6B is a graph of an open-circuit, square wave during the start-up mode and a load wave form during the operational mode at a second frequency, which is higher than the first frequency of FIG. 6A.

FIG. 6A and FIG. 6B are amplitude versus time graphs of inverter output wave forms during the start-up mode and operational mode. During the start-up mode, the no-load, root-mean-squared voltage output remains constant at the two different frequencies illustrated in FIG. 6A and FIG. 6B. In contrast, during the operational mode, the load, root-mean-squared voltage varies considerably at different frequencies of FIG. 6A and FIG. 6B. The maximum output power during the operational frequency occurs at approximately 40 KHz, while the minimum output power occurs at approximately 100 KHz.

FIG. 6A shows a first no-load (i.e. open-circuit) output wave form 600 and a first load wave form 602 for comparison at a first frequency. The first no-load output wave 600 is a true square wave, while the first load wave form 602 is a sinusoidal wave form. A simple sinusoidal wave has less root mean square voltage than a square wave with an equivalent, peak amplitude. Therefore, the no-load output wave form 600 represents a greater peak voltage and a greater root-mean-squared voltage than the load wave form 602.

FIG. 6B shows a second no-load wave form 604 and a second load wave form 606 at a second frequency. The first frequency of FIG. 6A is lower than the second frequency of FIG. 6B. The no-load voltage has a constant maximum value at both the first frequency and the second frequency in keeping with FIG. 5. The peak voltage of the first no-load wave form 600 and the peak voltage of the second no-load wave form 604 are approximately the same. The no-load wave form voltage varies between the maximum value of positive 350 volts and a minimum of negative 350 volts.

While the load voltage output of both the first load wave form 602 and the second load wave form 606 varies between a maximum of positive 225 volts and a minimum of negative 225 volts, the root mean squared voltage of the first load wave form 602 is greater than the root mean squared voltage of the second load wave form 606. The second load wave form 606 is more peaked than the first load wave form 602. The second load wave form 606 is an angular sinusoidal wave that resembles a triangular wave, while the first load wave form 602 resembles a simple sinusoidal wave. Given the same peak voltage, an angular sinsoidal wave, or a triangular wave, has a lower root-mean-squared (RMS) voltage value that a corresponding simple sinusoidal wave. In comparison, a square wave has a relatively high RMS voltage value which is equal to the peak voltage.

Lighting System Incorporating the Electronic Ballast

Figure 7A:
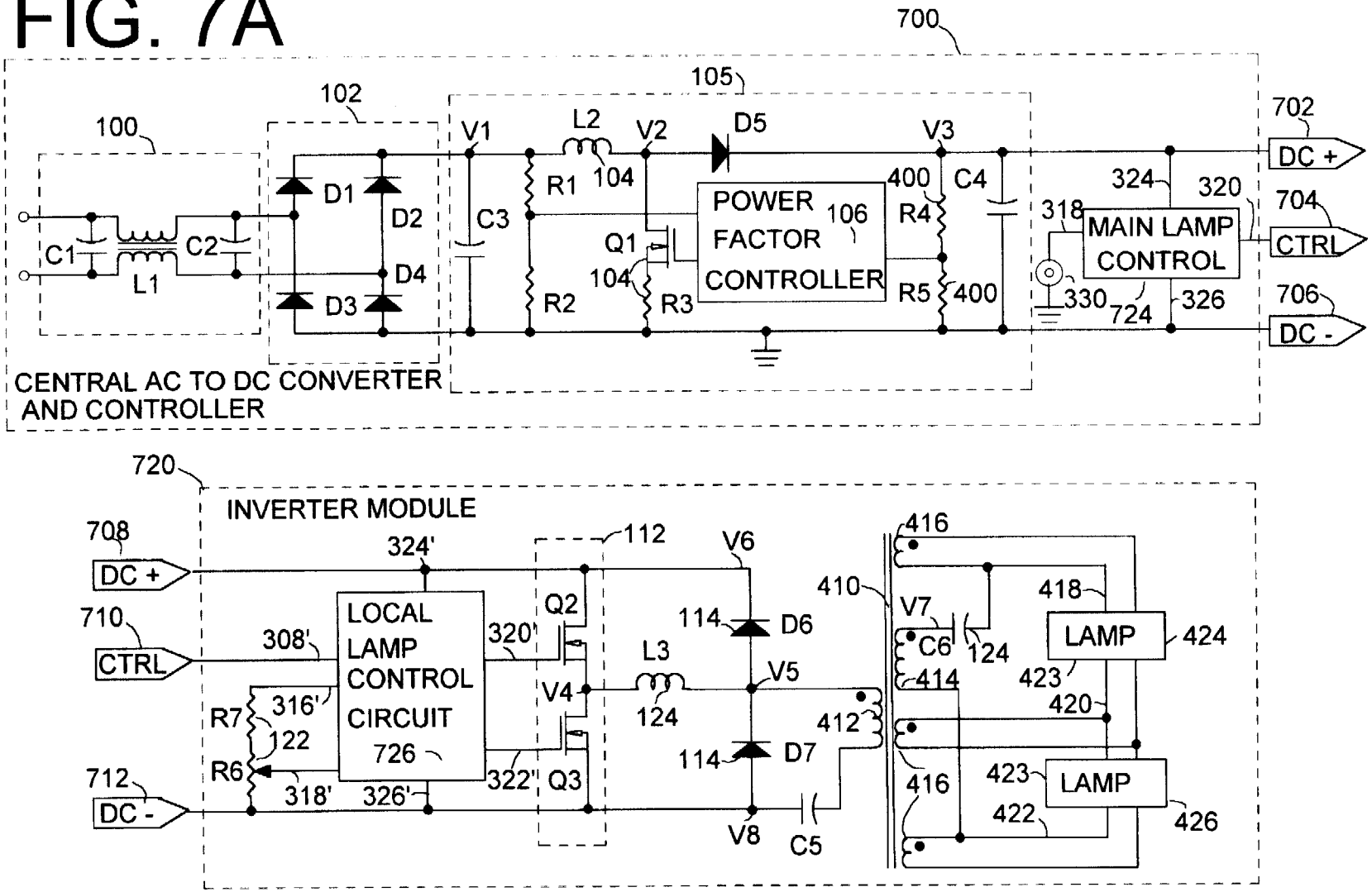
FIG. 7A shows a schematic diagram of an electronic ballast with a central ballast unit and a remote inverter.
Figure 7B:
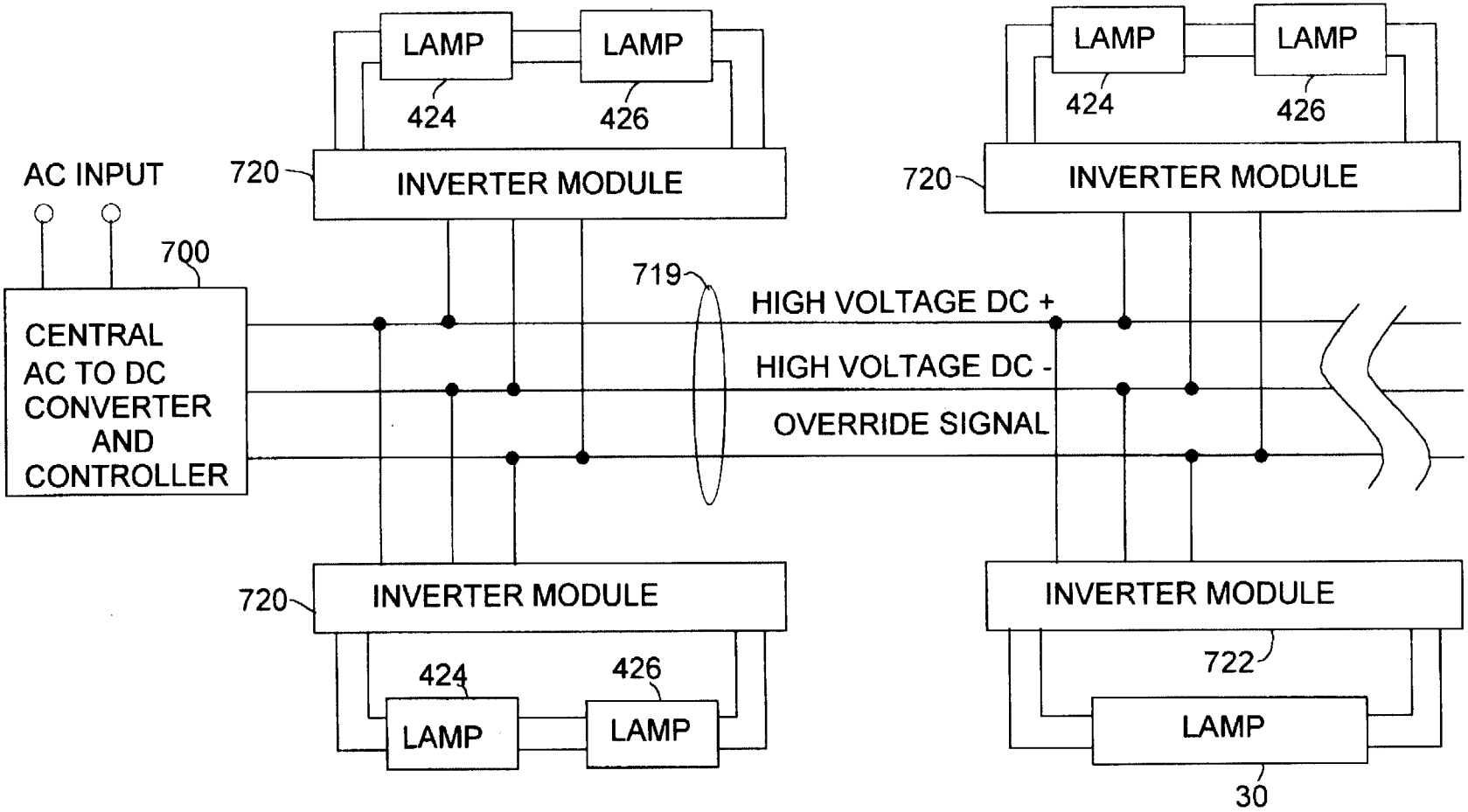
FIG. 7B shows a lighting system featuring the central ballast unit and a group of remote inverters.

FIG. 7A shows an alternate embodiment of the electronic ballast in which the ballast has a single central ballast unit 700 and a multiple-lamp, remote inverter 720. FIG. 7B is a lighting system in which the central ballast unit 700 provides appropriate DC power to remote inverters. The remote inverters include single-lamp, remote inverters 722 and/or multiple-lamp remote inverters 720. The central ballast unit 700 optionally supplies a control signal to the remote inverters to control the luminance of their associated lamps.

The central ballast unit 700 includes a line filter 100, a rectifier 102, a power preregulator 105, and a main lamp control circuit 724. The foregoing elements of the central ballast unit are identical to elements previously disclosed in the specification.

The multiple-lamp remote inverter 720 includes a square-wave amplifier 112, clamping diodes D6 and D7, a resonant circuit 124, a step-up transformer 410, and a local lamp control circuit 726. The foregoing elements of the multiple-lamp remote inverter unit are identical to elements previously disclosed in the specification. For example, the transformer 410 and transformer secondary circuitry in the multiple-lamp remote inverter 720 are the same as the transformer 410 and the transformer secondary circuitry described in conjunction with FIG. 4A.

The single-lamp remote inverter 722 is identical to the multiple-lamp remote inverter 720 except for the step-up transformer. The single-lamp remote inverter 722 has the step-up transformer 118 and transformer secondary circuitry as described in conjunction with FIG. 1A and FIG. 1B.

The main lamp control circuit 724 of FIG. 7A is preferably identical to the lamp control circuit 109 of FIG. 1C. The local lamp control circuit 726 of FIG. 7A is optimally identical to the lamp control circuit 109 of FIG. 1C. In other words, the main lamp control circuit 724 and the local lamp control circuit 726 are duplicates of the same circuitry. Accordingly, the main lamp control circuit 724 and the local lamp control circuit 726 have been renumbered and renamed from "lamp control circuit 109" to differentiate them from one other. The input/output terminals of the main lamp control circuit 724 retain the numbering scheme of FIG. 1C. However, the input/output terminals of the local lamp control circuit 726 have been relabeled with the addition of the "prime" symbol to avoid confusion.

The main control output 704 is taken from the driver output of the driver 111. The main control output 704 represents the terminal previously designated as the first driver output 320 or the second driver output 322 in FIG. 1C. The remote control input 710 of the remote lamp control circuit is merely a more appropriate name for the auxiliary oscillator input 308' in the context of the remote inverter. The main control output 704 is connected to the remote control input 710. In other words, the auxiliary oscillator input 308' of the remote inverter is connected to the first driver input 320 or the second driver input 322 of the central ballast unit 700.

The central ballast unit 700 or a particular remote inverter controls the luminance of lamps that are associated with the particular remote inverter. The central ballast unit 700 or the particular remote inverter controls the luminance of the lamp (or lamps), depending upon the position of the oscillator bypass switch 306' in the local lamp control circuit 726. If the oscillator bypass switch 306' is in a first state, the bypass switch 306' couples the central control output 704 to the driver 111' in the remote inverter. As a result, the central ballast unit 700 and its main oscillator 110 determines the brightness of the lamp by selecting the main oscillator frequency of the square wave transmitted to the remote inverter.

On the other hand if the bypass switch 306' is in a second state the bypass switch 306' couples the oscillator 110' in the local lamp control unit 726 to the driver 111' of the same local control unit 726. A user then can manually adjust the potentiometer R6 of the control input interface 122 to determine the lamps luminance from the remote inverter. The remote oscillator 110' determines the remote oscillator frequency of the remote inverter when the bypass switch 306' is in the second state.

The central ballast unit 700 provides two signals to the remote inverters (i.e. multiple-lamp remote inverter 720) over a common bus 719. The two signals include the DC bus voltage signal and the main control output signal. The DC bus voltage signal is supplied by the main positive DC bus 702 and on the main negative DC bus 706. The remote positive DC bus 708 and the remote negative DC bus 712 receive the DC voltage via the common bus 719. The control signal is carried on the main control output 704 with reference to the main negative DC bus 706.

The magnitudes of the DC bus voltages allow the use of relatively thin diameter conductors for the common bus 719 compared to typical AC lamp power wiring. Increasing DC bus voltage from the central ballast unit 700 lowers the current drawn by the remote inverters. The signals are conveyed efficiently over the common bus 719 because of the aforementioned high voltage and low current attributes. Any desired mix of single-lamp remote inverters 722 and multiple-lamp remote inverters 720 are connected in parallel to the common bus 719.

The foregoing detailed description is provided in sufficient detail to enable one of ordinary skill in the art to make and use the electronic ballast. The foregoing detailed description is merely illustrative of several physical embodiments of the electronic ballast and the inverter subassembly. Physical variations of the electronic ballast, not fully described within the specification, are encompassed within the purview of the claims. Accordingly, the narrow description of the elements in the specification should be used for general guidance rather than to unduly restrict the broader description of the elements in the following claims.

I claim:

1. An electronic ballast for energizing a gas-discharge lamp, the electronic ballast comprising:

a square-wave amplifier having a square-wave amplifier input and a square-wave amplifier output;

a lamp control circuit including an oscillator; the oscillator oscillating at any oscillator frequency within an entire oscillator frequency range during a start-up mode of the lamp, the lamp control circuit providing a signal at the oscillator frequency to the square-wave amplifier input;

a resonant circuit coupled to the square-wave amplifier output; the resonant circuit having a resonant frequency, a relative frequency difference between the oscillator frequency and the resonant frequency determining the luminance of the lamp during an operational mode of the lamp;

a step-up transformer having a primary winding and a secondary winding; the primary winding receiving electromagnetic energy from the square-wave amplifier output; a ratio of primary winding turns to secondary winding turns selected to provide a transformer secondary voltage that equals or exceeds a start-up threshold voltage of the lamp, the ratio depending upon a transformer primary voltage.

2. The electronic ballast according to claim 1 further comprising a lamp and wherein the resonant circuit includes a capacitor and an inductor, the inductor connected between the square-wave amplifier output and the primary winding, and the capacitor coupling the secondary winding to the lamp.

3. The electronic ballast according to claim 2 further comprising:

a direct current source providing a direct current voltage to the square-wave amplifier;

inhibiting means for inhibiting unwanted resonance of the resonant circuit during the start-up mode; the inhibiting means connected to a junction of the primary winding and the inductor; the inhibiting means providing a current path for voltages at the junction that exceed said direct current voltage.

4. The electronic ballast according to claim 3 wherein the inhibiting means comprise a first clamping diode and a second clamping diode, the first clamping diode having its anode connected to the junction of the inductor and the primary winding, the first clamping diode having its cathode connected to a positive polarity of the direct current source; the second clamping diode having its cathode connected to said junction and its anode connected to a negative polarity of the direct current source.

5. The electronic ballast according to claim 1 wherein the lamp control circuit further comprises:

an oscillator controller providing a control signal to the oscillator that determines the oscillator frequency, the control signal allowing the oscillator to oscillate at any selected oscillator frequency within the entire oscillator frequency range during the start-up mode of the lamp; and a driver having a driver input and a driver output, the driver input receiving electromagnetic energy from the oscillator, the driver output connected to the square-wave amplifier input.

6. The electronic ballast according to claim 5 wherein the oscillator controller includes an amplifier and wherein the oscillator comprises a voltage controlled oscillator; the amplifier providing an adjustable output voltage to the oscillator.

7. The electronic ballast according to claim 6 wherein the amplifier has a control input, a reference input, and wherein the control input is coupled or connected to a resistive divider, the resistive divider including a potentiometer for adjusting the voltage at the control input.

8. The electronic ballast according to claim 5 wherein the oscillator controller provides the control signal with same magnitude during the start-up mode and the operational mode so that said selected oscillator frequency remains the same during the start-up mode and the operational mode.

9. The electronic ballast according to claim 5 wherein the oscillator comprises a voltage-controlled oscillator with a frequency-determining input and wherein said oscillator controller comprises an adjustable gain amplifier, the adjustable gain amplifier having its output coupled or connected to the frequency determining input.

10. The electronic ballast according to claim 5 further comprising:

a rectifier, the rectifier supplying direct current to the square-wave amplifier via a direct current bus; and wherein said oscillator controller comprises an amplifier, the amplifier amplifying a difference between a control input and a reference input, the amplifier receiving a feedback voltage proportionally related to a bus voltage of the direct current bus, the amplifier generating a control output, or error voltage, to vary the oscillator frequency in response to a variation in the bus voltage.

11. The electronic ballast according to claim 5 wherein said oscillator controller comprises an amplifier, the amplifier having a control input and an output, the control input coupled to an external variable voltage source, and the output coupled to a frequency-determining input of the oscillator.

12. The electronic ballast according to claim 11 wherein said external variable voltage source comprises a voltage source selected from the group consisting of a daylight-sensor-controlled voltage source, an occupancy-sensor-controlled voltage source, a dimming switch, and a dimmer.

13. The electronic ballast according to claim 1 wherein the square-wave amplifier comprises a half-bridge amplifier for an inverter circuit.

14. The electronic ballast according to claim 1 further comprising:

a lamp being energized by the secondary winding of said step-up transformer during the start-up mode, the lamp being energized by the resonant circuit and the step-up transformer during the operational mode.

15. The electronic ballast according to claim 1 further comprising multiple lamps oriented in series with respect to one another, the lamps being energized by said secondary winding.

16. The electronic ballast according to claim 1 further comprising a first lamp and a second lamp, the first lamp electrically connected or coupled to the second lamp, the first lamp connected to the secondary winding at a first secondary connection, the second lamp connected to the secondary winding at a second secondary connection; the first secondary connection and the second secondary connection being energized by the secondary winding.

17. The electronic ballast according to claim 1 wherein the oscillator controller further comprises:

a direct current voltage bus providing energy for the square-wave amplifier;

a plurality of amplifiers including a first amplifier, a second amplifier, and a third amplifier; the first amplifier having a first control input, the second amplifier having a second control input, the third amplifier having a third control input; said amplifiers having reference voltage inputs and control outputs; and selection means for selecting one of said amplifiers; a selected one of the control outputs coupled to the oscillator via the selection means.

18. The electronic ballast according to claim 17 wherein the first control input accepts a feedback voltage from the direct current voltage bus, the second control input accepts an external voltage source, the third control input accepts a variable voltage source controlled by a potentiometer; the selection means comprising an analog OR logic circuit.

19. An inverter for initially energizing a gas discharge lamp in a start-up mode and subsequently operating the gas-discharge lamp in an operational mode, the inverter comprising:

a square-wave amplifier, the square-wave amplifier having a square-wave amplifier input and a square-wave amplifier output;

a transformer having a primary winding and a secondary winding, a ratio of turns of the primary winding to the secondary winding selected to provide a sufficient threshold voltage on the secondary winding during the start-up mode to initially illuminate the lamp;

a first resonant element connected to the primary winding and the square-wave amplifier output, a second resonant element connected to the secondary winding; the second resonant element electrically floating during the start-up mode; the first resonant element and the second resonant element only forming a series resonant circuit during the operational mode of the lamp; the series resonant circuit having a resonant frequency;

a lamp control circuit including an oscillator having an oscillator frequency, the oscillator frequency designated as a starting frequency during the start-up mode and an operational frequency during the operational mode; the oscillator being associated with the square-wave amplifier; the lamp control circuit determining a frequency separation between the operational frequency and the resonant frequency to adjust luminance of the lamp during the operational mode.

20. The electronic ballast according to claim 19 further comprising:

inhibiting means for inhibiting unwanted resonance of the first resonant element and the second resonant element during the start-up mode, the inhibiting means connected to the first resonant element such that the electronic ballast has a substantially fixed voltage output versus frequency characteristic dominated by the transformer during the start-up mode and such that the series resonant circuit yields a variable, ballast voltage output versus frequency characteristic only during the operational mode.

21. The electronic ballast of claim 20 wherein said inhibiting means comprise clamping diodes for limiting voltage stored in the first resonant element and voltage applied to the second resonant element to prevent the first resonant element and the second resonant element from exchanging energy and oscillating.

22. The inverter according to claim 19 wherein the first resonant element comprises an inductor connected to the primary winding and the square-wave amplifier output; and wherein the second resonant element comprises a capacitor connected to the principal secondary winding.

23. The inverter according to claim 19 wherein the lamp control circuit further comprises an oscillator controller, the oscillator controller providing one or more control output signals to the oscillator to determine the starting frequency and the operational frequency in response to a control input; the oscillator controller allowing the start-up frequency to be substantially independent of the resonant frequency, the oscillator controller controlling the operational frequency with respect to a frequency separation between the operational frequency and the resonant frequency to adjust the luminance of the lamp.

24. The electronic ballast according to claim 19 wherein the secondary winding is coupled to the lamp via the second resonant element.

25. The electronic ballast according to claim 19 further comprising:

multiple lamps; and wherein the secondary winding energizes said multiple lamps in series with one another.

26. The electronic ballast according to claim 19 further comprising a first lamp and a second lamp, the first lamp connected or coupled to the second lamp, the first lamp connected to the transformer at a first secondary connection, the second lamp connected to the transformer at a second secondary connection; the first secondary connection and the second secondary connection being energized by the secondary winding.

27. A lighting system for energizing multiple gas-discharge lamps comprising:

a central ballast unit, the central ballast unit including a converter and a main lamp control circuit; the converter having a positive direct current output and a negative direct current output, the main lamp control circuit including a main oscillator operating at a main oscillator frequency, the main lamp control circuit having a control input and a main control output;

a plurality of remote inverters, the remote inverters connected to the central ballast unit; each remote inverter comprising a square-wave amplifier, a transformer, and a resonant circuit;

the square-wave amplifier having a square-wave amplifier input and an square-wave amplifier output, the square-wave amplifier manipulating power from the positive direct current output and the negative direct current output;

the transformer having a primary winding and a secondary winding, the ratio of turns on the primary winding to the secondary winding selected to provide a sufficient threshold voltage during a start-up mode to illuminate at least one lamp; and the resonant circuit coupled to the transformer and receiving the square-wave amplifier output, the resonant circuit having a resonant frequency in an operational mode following the start-up mode of the lamp.

28. The lighting system according to claim 27 wherein the main oscillator is responsive to the control input of the main lamp control circuit, the main lamp control circuit determining the main oscillator frequency during the operational mode of the lamp to provide a desired degree of luminance of the lamps at one or more remote units.

29. The lighting system according to claim 27 wherein each remote inverter further includes a local lamp control circuit, each local lamp control circuit having a corresponding remote oscillator and a corresponding oscillator bypass switch; each remote oscillator oscillating at a remote oscillator frequency determined by its respective local lamp control circuit, each oscillator bypass switch having a first state in which the switch's remote inverter is coupled to the main oscillator, the oscillator bypass switch having a second state in which the switch's remote oscillator is coupled to its remote inverter.

30. The lighting system according to claim 27 further comprising:

a common control bus for connecting the remote inverters in parallel with the central ballast unit; the common control bus having three conductors, the three conductors carrying the positive direct power output, the negative direct power output, and the main control output; the maximum current carrying capacity and the requisite size of the conductors being reduced as the requisite voltage output of the converter is increased.

31. The lighting system according to claim 27 wherein each remote inverter has a local lamp control circuit and a remote oscillator, the local lamp control circuit individually controlling the remote oscillator frequency of its remote inverter.

32. The lighting system according to claim 27 wherein the resonant circuit includes a capacitor and an inductor, the inductor connected between the square-wave amplifier output and the primary winding, and the capacitor coupling the secondary winding to the lamp.

33. The lighting system according to claim 27 further comprising:

clamping diodes connected to a junction of the primary winding and the inductor; the clamping diodes providing a current path for output voltages at the junction that exceed the positive direct power output or the negative direct power output.

34. The lighting system according to claim 33 wherein the clamping diodes comprises a first clamping diode and a second clamping diode, the first clamping diode having its anode connected to the junction of the inductor and the primary winding, the first clamping diode having its cathode connected to a positive polarity of the direct current source; the second clamping diode having its cathode connected to said junction and its anode connected to a negative polarity of the direct current source.

35. The lighting system according to claim 27 further comprising multiple lamps electrically connected or coupled in series with each other, the multiple lamps being energized by the principal secondary winding during the operational mode.

* * * * *